US011089892B2

(12) United States Patent
Manochio

(10) Patent No.: US 11,089,892 B2
(45) Date of Patent: Aug. 17, 2021

(54) CYLINDRICAL CONTAINER

(71) Applicant: Nicholas Michael Manochio, Middletown, NJ (US)

(72) Inventor: Nicholas Michael Manochio, Middletown, NJ (US)

( * ) Notice: Subject to any disclaimer, the term of this patent is extended or adjusted under 35 U.S.C. 154(b) by 0 days.

(21) Appl. No.: 16/949,542

(22) Filed: Nov. 3, 2020

(65) Prior Publication Data

US 2021/0186240 A1 Jun. 24, 2021

Related U.S. Application Data

(60) Provisional application No. 62/951,315, filed on Dec. 20, 2019.

(51) Int. Cl.
*A47G 19/22* (2006.01)

(52) U.S. Cl.
CPC ..... *A47G 19/2227* (2013.01); *A47G 19/2272* (2013.01); *A47G 19/2288* (2013.01)

(58) Field of Classification Search
CPC ..... A47G 19/2227; A47G 19/2272; A47G 19/2288; A47G 19/2205
(Continued)

(56) References Cited

U.S. PATENT DOCUMENTS 1,180,132 A 7/1876 Hoard et al.
3,601,250 A 8/1971 Merila
(Continued)

FOREIGN PATENT DOCUMENTS

AU 2019100149 B4 7/2019
CN 201256842 Y 6/2009
(Continued)

OTHER PUBLICATIONS

Yongkang Sheng Qiang Stainless Steel Products Manufactory, "16Oz Sublimation Plastic Travel Mug With Insert Personalized Photo Coffee Mug With Removable Insert ", Product Information, retrieved on Feb. 10, 2020 from https://www.alibaba.com/product-detail/16oz-Sublimation-plastic-travel-mug-with_60761334059.html, 7 Pages.

(Continued)

*Primary Examiner* — James N Smalley
*Assistant Examiner* — Madison L Poos
(74) *Attorney, Agent, or Firm* — Patrick Garrett; John Maldjian; Maldjian Law Group LLC

(57) ABSTRACT

A cylindrical container comprising: a main body, to store a beverage or a solid material, having a top end and a bottom end; a plurality of side panels, attached to each other, to form an insulated cover around the main body; a bottom lid, having an exterior wall and an interior wall, wherein an outer surface of the interior wall comprises a bottom lid thread to be screwed onto the bottom end of the main body or a top end of the main body to fully enclose the cylindrical container; a standard lid, having an exterior wall and an interior wall, wherein an outer surface of the interior wall comprises an interior lid thread to be screwed onto an interior thread provided at the top end of the main body; and a vacuum seal lid, having a flat top portion and a ring portion, wherein the ring portion comprises an O-ring hole along a circumference of the ring portion for accepting an O-ring to create a vacuum seal.

20 Claims, 26 Drawing Sheets

(58) Field of Classification Search
USPC ..... 220/592.17
See application file for complete search history.

(56) References Cited

U.S. PATENT DOCUMENTS

| | | | | |
|---|---|---|---|---|
| 3,732,999 | A | 5/1973 | Rounkles | |
| 3,946,895 | A | 3/1976 | Pugh | |
| 4,127,212 | A | 11/1978 | Waterbury | |
| 4,334,028 | A | 6/1982 | Carver | |
| 4,570,817 | A | 2/1986 | Hambleton et al. | |
| 5,040,317 | A * | 8/1991 | Kadjevich | G09F 23/08 40/324 |
| 5,402,904 | A | 4/1995 | Close | |
| 5,429,364 | A * | 7/1995 | Chang | A47G 19/2227 273/153 S |
| 5,465,835 | A | 11/1995 | Schumacher et al. | |
| 5,525,383 | A | 6/1996 | Witkowski | |
| 5,531,353 | A * | 7/1996 | Ward | A47G 19/2227 220/23.86 |
| 5,624,053 | A | 4/1997 | Freek et al. | |
| 5,729,922 | A | 3/1998 | Peterson et al. | |
| 5,913,442 | A | 6/1999 | Wu | |
| 5,918,761 | A | 7/1999 | Wissinger | |
| 6,196,413 | B1 | 3/2001 | Tung | |
| 6,302,295 | B1 | 10/2001 | Weisman | |
| 6,439,442 | B1 | 8/2002 | Markert et al. | |
| 6,443,324 | B1 | 9/2002 | Buntain | |
| 6,491,041 | B1 | 12/2002 | Okamoto | |
| 6,520,369 | B1 | 2/2003 | Cytacki | |
| 6,561,376 | B2 | 5/2003 | Price et al. | |
| 6,752,287 | B1 | 6/2004 | Lin | |
| 6,984,425 | B2 | 1/2006 | Raymond | |
| 7,007,819 | B2 | 3/2006 | Pollack | |
| 7,097,065 | B2 | 8/2006 | Yoneoka et al. | |
| 7,275,653 | B2 | 10/2007 | Tedford, Jr. | |
| 7,591,389 | B2 | 9/2009 | Wong | |
| 7,703,226 | B2 | 4/2010 | Schnuckle | |
| 7,753,224 | B2 | 7/2010 | Cai | |
| 7,845,510 | B2 | 12/2010 | Schmidtner et al. | |
| 7,900,384 | B2 | 3/2011 | Schnuckle | |
| 8,046,941 | B2 | 11/2011 | Schnuckle | |
| 8,281,929 | B2 | 10/2012 | Franks et al. | |
| 8,381,935 | B1 | 2/2013 | Buck | |
| 8,550,269 | B2 | 10/2013 | Lane | |
| 8,695,839 | B1 | 4/2014 | Vanderberg | |
| 8,714,403 | B2 | 5/2014 | Amprimo | |
| 8,726,549 | B2 | 5/2014 | Regas | |
| 8,757,404 | B1 | 6/2014 | Fleckenstein | |
| 8,777,044 | B1 | 7/2014 | Raymus et al. | |
| 8,870,010 | B2 | 10/2014 | Buck | |
| 9,027,774 | B2 | 5/2015 | Palmer | |
| 9,078,535 | B1 | 7/2015 | Buck | |
| 9,119,507 | B2 | 9/2015 | Abrams et al. | |
| 9,145,221 | B2 | 9/2015 | Kalyanpur et al. | |
| 9,380,898 | B2 | 7/2016 | Mason | |
| 9,390,633 | B2 | 7/2016 | Corbett | |
| 9,565,958 | B2 | 2/2017 | Liu et al. | |
| 9,603,471 | B2 | 3/2017 | Green | |
| 9,604,747 | B2 | 3/2017 | Torres | |
| 9,776,765 | B2 | 10/2017 | Stephens et al. | |
| 9,856,053 | B2 | 1/2018 | Pisarevsky | |
| 10,144,551 | B2 | 12/2018 | Ni | |
| 10,183,789 | B1 | 1/2019 | Lin | |
| 10,232,993 | B2 | 3/2019 | Seiders | |
| 10,433,664 | B2 | 10/2019 | Brannock | |
| 10,669,070 | B2 | 6/2020 | Lane, II et al. | |
| 2002/0030063 | A1 | 3/2002 | Leray et al. | |
| 2003/0146221 | A1 | 8/2003 | Lauer et al. | |
| 2004/0049957 | A1 | 3/2004 | Richards | |
| 2004/0056037 | A1 | 3/2004 | Richards | |
| 2005/0040052 | A1 | 2/2005 | Dixon | |
| 2005/0082295 | A1 | 4/2005 | Jagger et al. | |
| 2006/0028014 | A1 | 2/2006 | McQueeny et al. | |
| 2006/0131188 | A1 | 6/2006 | Lindemann | |
| 2006/0191932 | A1 | 8/2006 | Bocola | |
| 2008/0142520 | A1 | 6/2008 | Morgan | |
| 2008/0149589 | A1 | 6/2008 | Lach | |
| 2008/0171153 | A1 | 7/2008 | Weston et al. | |
| 2008/0202950 | A1 | 8/2008 | Anderson | |
| 2008/0296181 | A1 | 12/2008 | Stephens et al. | |
| 2008/0296246 | A1 | 12/2008 | Chow | |
| 2009/0026218 | A1 | 1/2009 | Wong | |
| 2009/0101654 | A1 | 4/2009 | Brashear | |
| 2010/0264152 | A1 | 10/2010 | Hirst et al. | |
| 2011/0198355 | A1 | 8/2011 | Mullen | |
| 2012/0012551 | A1 | 1/2012 | Sinacori et al. | |
| 2012/0205371 | A1 | 8/2012 | Lee | |
| 2012/0298676 | A1 | 11/2012 | Cooks | |
| 2013/0233871 | A1 | 9/2013 | Gluck | |
| 2014/0069946 | A1 | 3/2014 | Gubitosi et al. | |
| 2016/0088960 | A1* | 3/2016 | Liang | B65D 81/3869 220/560.01 |
| 2016/0174743 | A1 | 6/2016 | Childs | |
| 2016/0304247 | A1 | 10/2016 | Lewison, Jr. et al. | |
| 2017/0071376 | A1 | 3/2017 | Vandenlangenberg | |
| 2017/0121074 | A1* | 5/2017 | Seiders | B65D 51/1605 |
| 2017/0245624 | A1 | 8/2017 | Neves | |
| 2017/0337725 | A1 | 11/2017 | White et al. | |
| 2018/0140120 | A1 | 5/2018 | Shackelford | |
| 2018/0289185 | A1 | 10/2018 | Oakes | |
| 2019/0053649 | A1 | 2/2019 | Novak et al. | |
| 2019/0117000 | A1 | 4/2019 | Lockhart et al. | |
| 2019/0218011 | A1 | 7/2019 | Wang | |
| 2019/0263573 | A1 | 8/2019 | Taylor | |
| 2019/0274457 | A1 | 9/2019 | Robertson | |
| 2020/0140135 | A1 | 5/2020 | Deylamian et al. | |

FOREIGN PATENT DOCUMENTS

| | | | |
|---|---|---|---|
| CN | 202653465 | U | 1/2013 |
| CN | 202723386 | U | 2/2013 |
| CN | 203000271 | U | 6/2013 |
| CN | 203234227 | U | 10/2013 |
| CN | 203638438 | U | 6/2014 |
| CN | 204236947 | | 4/2015 |
| CN | 206243737 | U | 6/2017 |
| CN | 207733976 | U | 8/2018 |
| CN | 208425836 | U | 1/2019 |
| CN | 210149917 | U | 3/2020 |
| CN | 210446790 | U | 5/2020 |
| CN | 210734961 | U | 6/2020 |
| DE | 102017120822 | A1 | 3/2019 |
| EP | 3575230 | A1 | 12/2019 |
| FR | 2690671 | A1 | 11/1993 |
| GB | 2433418 | A | 6/2007 |
| GB | 2484270 | A | 4/2012 |
| GB | 201209315 | | 7/2012 |
| KR | 20110106033 | A | 9/2011 |
| KR | 20150094209 | A | 8/2015 |
| KR | 101919108 | B1 | 2/2019 |
| TW | M435434 | U | 8/2012 |
| TW | I680083 | B | 12/2019 |
| WO | 9426602 | A1 | 11/1994 |
| WO | 02/059009 | A1 | 8/2002 |
| WO | 2004048216 | A1 | 6/2004 |
| WO | 2007134377 | A1 | 11/2007 |
| WO | 2019184396 | A1 | 10/2019 |

OTHER PUBLICATIONS

Shenzhen Biansebao Arts & Crafts Compan Ltd, "450Ml Double Wall Removable Paper Insert Plastic Coffee Mugs Paper Insert Mug", Product Information, retrieved on Feb. 10, 2020 from https://www.alibaba.com/product-detail/450ml-Double-Wall-Removable-Paper-Insert_60472835583.html, 4 Pages.

Tantra, "Tantra Magic Bottle Tumbler, Suction Cup, Non-Spill Mug, Mighty Mug, Office Bottle, Gym Sports Sipper Bottle Capacity-540Ml", Product Information, retrieved on Feb. 10, 2020 from https://www.amazon.in/TANTRA-Bottle-Tumbler-Suction-Non-Spill/dp/B06X9LQ8YS, 2 Pages.

Revolutionparts, "Bmw Roundel Travel Mug—24 Oz", Product Information, retrieved on Feb. 7, 2020 from https://www.getbmwparts.

(56) References Cited

OTHER PUBLICATIONS com/oem-parts/bmw-bmw-roundel-travel-mug-24-oz-80902475194?c=bD0zMSZuPUNhdGVnb3J5IFBhZ2U%3D, 2 Pages.
Bebetter Life, "Bebetter Yeti Lid With Slider Closure for Yeti Ozark Boss Rambler Tumbler", Product Information, retrieved on Feb. 7, 2020 from https://www.amazon.in/Bebetter-Slider-Closure-Rambler-Tumbler/dp/B01MU8QERZ, 1 Page.
Shopee, "Splash Spill Proof Lid for 20 30 Oz Ozark Trail Rtic Yeti Rambler Tumbler Cup", Product Information, retrieved on Feb. 7, 2020 from https://www.alibaba.com/product-detail/16oz-Sublimation-plastic-travel-mug-with_60761334059.html, 2 Pages.
Ello Products, "Elio Ogden Ceramic Travel Mug With Friction/Fit Lid", Product Information, retrieved on Feb. 7, 2020 from https://www.amazon.com/gp/product/B01FZD7F8Q/ref=as_li_tl?ie=UTF8&tag=campingcoffee-20&camp=1789&creative=9325&linkCode=as2&creativeASIN=B01FZD7F8Q&linkId=b37492aa9fea12599c83ff1e3e4d424f, 2 Pages.
Norchill® Coolers & Drinkware, "Universal Tumbler Lids", Product Information, retrieved on Feb. 7, 2020 from https://norchillcoolers.com/pages/tumbler-lids, 4 Pages.
Ubuy Co, "Yoelike 30 Oz Tumbler Double Wall Stainless Steel Vacuum Insulated Travel Mug (Bohemia, 30 Oz)"Product Information, retrieved on Feb. 7, 2020 from https://www.a.ubuy.com.kw/en/search/index/view/product/B01GQI54PK/s/yoelike-30-oz-tumbler-double-wall-stainless-steel-vacuum-insulated-travel-mug-with-2-straws-2-splash-proof-lid-1-cleaning-brush-1-straw-cleaning-brush-bohemia-30-oz/store/store/kk/dp, 2 Pages.
Recpro, "20Oz Tumbler Vacuum Insulated 18/8 Stainless Steel Cup W/ Slider Lid", Product Information, retrieved on Feb. 7, 2020 from https://www.recpro.com/20oz-tumbler-vacuum-insulated-18-8-stainless-steel-cup-w-slider-lid/, 2 Pages.
Anhui Taicheng Paper & Plastic Technology Co., Ltd., "Promotional Cheap Plastic Diy Coffee Travel Mug With Photo Insert", Product Information, retrieved on Nov. 13, 2019 from https://alltableware.en.made-in-china.com/product-catalog/Plastic-Cup-Mug-1.html, 2 Pages.
"30Oz Ice Pa Cup, Stainless Steel Vacuum Cups Car Ice Cup With Cup Cover", Product Information, retrieved on Nov. 13, 2019 from https://shopee.com.my/amp/30OZ-Ice-PA-Cup-Stainless-Steel-Vacuum-Cups-Car-Ice-Cup-with-Cup-Cover-i.107143912.1704046429, 2 Pages.
Kodiak Coolers, "20Oz Kodiak Tundra Tumbler W/ 2 Lids", Product Information, retrieved on Nov. 13, 2019 from http://www.woodworkingparts.com/clearance-20oz-kodiak-tundra-tumbler-w-2-lids-powder-coated-stainless-free-shipping/, 2 Pages.
Yeti Coolers, LLC., "Yeti 20 Oz. Rambler Tumbler Straw Lid", Product Information, retrieved on Nov. 13, 2019 from https://www.dickssportinggoods.com/p/yeti-20-ozrambler-tumbler-straw-lid-16yeturmblamblr2odr/16yeturmblrtmblr2odr, 3 Pages.
Youzi, Ltd., "Youzi 2 Pack Spill Proof and Splash Resistant Lid for Yeti Rtic Ozark Trails Tumbler Rambler Cups 30 Oz", Product Information, retrieved on Nov. 13, 2019 from https://www.amazon.com/Splash-Resistant-Trails-Tumbler-Rambler/dp/B075QZCS3J?tag=vehiclegps09-20, 2 Pages.
Epoca International, "Primula 20 Oz Thermal Hot or Cold Tumbler Cup W/ Lid and Gift Box New", Product Information, retrieved on Nov. 13, 2019 from https://www.ebay.ca/itm/PRIMULA-20-OZ-Thermal-Hot-or-Cold-Tumbler-Cup-w-Lid-and-Gift-Box-New-Gunmetal/323779977467?hash=item4b62ca60fb:g:w3gAAOSwITZccfe3, 2 Pages.
Dollar Tree Inc., "Customizable Photo Travel Mugs With Flip-Top Closures, 11 Oz", Product Information, retrieved on Nov. 13, 2019 from https://www.dollartree.com/customizable-photo-travel-mugs-with-flip-top-closures-11oz/197308, 1 Page.
Great American Products, "Philadelphia Phillies 2Oz Acrylic/Stainless Steel Shot Glass W/Metallic Graphics", Product Information, retrieved on Nov. 13, 2019 from http://www.gap1.com/store/p/39963-Philadelphia-Phillies-2oz-Acrylic/Stainless-Steel-Shot-Glass-w/Metallic-Graphics.html, 2 Pages.
Bindle Bottle, "Bindle Bottle", Product Information, retrieved on Jul. 17, 2020 from https://bindlebottle.com/, 2 Pages.
"Stainless Steel Tumbler Safe Water Bottle", Product Information, retrieved on Jul. 17, 2020 from https://www.aliexpress.com/i/4000166861654.html, 1 Page.
"Advertising Paper Insert Coffee Cups, 16Oz Stainless Steel Coffee Cups With Custom Paper Insert, Double Walled Paper Coffee Cups", Product Information, retrieved on Jul. 17, 2020 from https://www.alibaba.com/product-detail/Advertising-paper-insert-coffee-cups-16oz_62021355166.html?spm=a2700.7724857.normalList.1.5f3c519doUfCO2, 3 Pages.
Battle Mug, "Gun Rails Mugs & Cups—Battle Mug", Product Information, retrieved on Jul. 17, 2020 from https://battlemug.com/collections/gun-rails, 5 Pages.
Travah, "Diversion Safe Water Bottle", Product Information, retrieved on Jul. 17, 2020 from https://www.amazon.com/Tumbler-Diversion-Stainless-Valuables-Insulated/dp/B07MGWB4TL, 2 Pages.
Blender Bottle, "Blender Bottle Gold's Gym ProStak 22 oz", Product Information, retrieved on Jul. 17, 2020 from https://www.amazon.com/Blender-Bottle-Golds-ProStak-Shaker/dp/B07DRPP73K, 2 Pages.
Yongkang Yawen Cup Co., Ltd., "Plastic Acrylic Tumbler With Removable Insert Paper,Paper Changeable Plastic Coffee Cup", Product Information, retrieved on Nov. 13, 2019 from https://alltableware.en.made-in-china.com/product-catalog/Plastic-Cup-Mug-1.html, 5 Pages.
Shenzhen Lampda Photoelectric Technology Co.Ltd, "Best selling energy products 2019 protein shaker bottle, drink mix bottle, storage bottle with compartment", Product Information, retrieved on Sep. 25, 2019 from https://www.alibaba.com/product-detail/Best-selling-energy-products-2019-protein_60451381645.html?spm=a2700.7724857.main07.24.e11f161azGThMi, 8 Pages.
Contigo, "Storage Compartment Water Bottle", Product Information, retrieved on Sep. 25, 2019 from https://www.awesomeinventions.com/shop/storage-compartment-water-bottle/, 5 Pages.
Deodap, "600ml Pill Box Organizer with Water Bottle Weekly Seven Compartments with Drinking Bottle", Product Information, retrieved on Sep. 25, 2019 from https://www.indiamart.com/proddetail/600ml-pill-box-organizer-with-water-bottle-weekly-seven-compartments-with-drinking-bottle-21300208555.html, 3 Pages.
primelinepromos.com, "20 Oz. Shaker Fitness Bottle w/Wireless Earbuds", Product Information, retrieved on Sep. 25, 2019 from https://primelinepromos.com/product/20-oz-shaker-fitness-bottle-w-wireless-earbuds/, 3 Pages.
Contigo, "Contigo Kangaroo Shake & Go Fit w/Storage Deep Blue 709ml", Product Information, retrieved on Sep. 25, 2019 from https://www.mightyape.co.nz/product/contigo-kangaroo-shake-go-fit-wstorage-deep-blue-709ml/27679243, 2 Pages.
Next Bottle, "Next Bottle", Product Information, retrieved on Sep. 25, 2019 from http://getnextbottle.com/ 5 Pages.
Mr. Stash Cap, Mr. Stash Cap Bottle Top Storage Compartment—Fits Plastic Soda or Water Containers, Providing Secret Hidden Diversion Spot Concealed in Lid, Can Safe in Bottles, Product Information, retrieved on Nov. 11, 2019 from https://www.amazon.com/Mr-Stash-Cap-Diversion-Compartment/dp/B076YH8QY1, 3 Pages.
Silver Lab, "Water Bottle with Storage Case", Product Information, retrieved on Sep. 25, 2019 from https://www.silverlab.co/products/water-bottle-with-storage-case, 5 Pages.
Sangfit, "Sangfit Water Bottle with Compartment for Keys, Money and Various Cards BPA free 750 ml", Product Information, retrieved on Sep. 25, 2019 from https://www.amazon.co.uk/Sangfit-Water-Bottle-Compartment- Various/dp/B06Y1H5MTP, 5 Pages.
Contigo, "Autospout® Straw Gizmo Flip", Product Information, retrieved on Nov. 11, 2019 from https://mycontigo.com/, 2 Pages.
Thermos L.L.C., "Funtainer® Stainless Steel Water Bottle With Straw 12Oz", Product Information, retrieved on Nov. 11, 2019 from https://www.thermos.com/genuine-thermos-brand-funtainer-vacuum-insulated-stainless-steel-bottle-12oz.html, 5 Pages.

* cited by examiner

CYLINDRICAL CONTAINER

CROSS REFERENCE TO RELATED APPLICATION

This application claims benefit and priority to U.S. Provisional Patent Application Ser. No. 62/951,315, filed Dec. 20, 2019, entitled, "BEVERAGE CONTAINER" which is incorporated herein by reference in its entirety.

FIELD OF INVENTION

Embodiments disclosed herein relate, in general, to a container and, more particularly, to a customizable container for holding a substance such as, a solid or a liquid.

BACKGROUND

Beverage containers have been used for years. Conventional beverage containers are made up of rigid plastic material to hold a beverage and/or a fluid within. However, holding the conventional beverage containers containing a hot beverage or a cold beverage sometimes becomes difficult as insulation provided in such containers is not up to the mark. Moreover, a user has to buy multiple beverage containers according to different requirements, such as, a separate beverage container for a hot beverage, a beverage container for a cold beverage, a beverage container for travelling purpose having different sizes, and etc. For example, some users prefer to have their beverage in a coffee style lid while other users prefer to use a straw with the beverage container to consume the beverage. In addition, multiple beverage containers require ample amount of space in cabinets for their storage and can also have spending concerns.

Conventional beverage containers having a clear exterior body that screws onto a main body of the container and further allows for a piece of paper to slide into are readily available. Moreover, the surrounding cover of such beverage containers can be permanent and/or available to be removed and changed. However, an area for holding the paper is not big enough to provide an exact fitting to the paper, which can cause the paper to move freely. Moreover, the paper design can overlap itself causing an unpleasant look for the beverage container.

US20120012551A1 discloses a beverage container with an interchangeable sleeve and a fixed handle. The container is a mug with a lid and the fixed handle that has a sleeve meant for decorative purpose attached to the mug. Moreover, the sleeve has a lip on all sides meant to slide into grooves at a bottom side and the lid of the main mug. Further, the lid has a skirt to accept the lip so it is secure when closed. U.S. Ser. No. 10/669,070B2 discloses a beverage container with interchangeable components. The container has a very specific locking mechanism of "Key Holes", and a rail to secure internal and external embodiments, and then another part would be attached to that. Further, the rail is attached to a mug handle on a side of the container. However, there is no specific design for any attachable panels.

However, such conventional beverage containers have complex designs. Moreover, these conventional beverage containers require multiple inserts and attachments for different types and/or sizes of the beverage containers. In addition, one beverage container can attach only one type of a lid. Therefore, a user has to buy multiple beverage containers having different type of lids for different usage purposes.

Thus, there is a need for a multipurpose cylindrical container that enables a user to easily customize and/or personalize the cylindrical container according to a specific need.

SUMMARY

Embodiments in accordance with the present invention provide a cylindrical container. The cylindrical container comprising: a main body, to store a beverage, wherein the main body comprising a top end and a bottom end. The cylindrical container further comprising a plurality of side panels, attached to one another, to form an insulated cover around the main body, wherein each of the plurality of side panels comprises a top panel lip and a bottom panel lip. Further, the cylindrical container comprises a bottom lid, having an exterior wall and an interior wall such that a height of the exterior wall is greater than a height of the interior wall, wherein an outer surface of the interior wall comprises a bottom lid thread to be screwed onto a bottom thread of an extended bottom wall provided at the bottom end of the main body. Further, the cylindrical container comprises a standard lid, having an exterior wall and an interior wall, wherein an outer surface of the interior wall comprises an interior lid thread to be screwed onto an interior thread of a lip provided at the top end of the main body. Further, the cylindrical container comprises a vacuum seal lid, having a flat top portion and a ring portion, wherein the ring portion comprises an O-ring hole along a circumference of the ring portion for accepting an O-ring to create a vacuum seal.

Embodiments in accordance with the present invention provide a cylindrical container. The cylindrical container comprising: a main body, to store a beverage, wherein the main body comprising a top end and a bottom end. The cylindrical container further comprising a plurality of side panels, attached to one another, to form an insulated cover around the main body, wherein each of the plurality of side panels comprises a top panel lip and a bottom panel lip. Further, the cylindrical container further comprises a bottom lid, having an exterior wall and an interior wall such that a height of the exterior wall is greater than a height of the interior wall, wherein an outer surface of the interior wall comprises a bottom lid thread to be screwed onto a bottom thread of an extended bottom wall provided at the bottom end of the main body. Further, the cylindrical container comprises a standard lid, having an exterior wall and an interior wall such that a height of the exterior wall is greater than a height of the interior wall, wherein an outer surface of the interior wall comprises an interior lid thread to be screwed onto an interior thread of a lip provided at the top end of the main body, wherein an inner surface of the exterior wall of the standard lid comprises an exterior lid thread to be screwed onto an exterior thread provided at the top end of the main body. Further, the cylindrical container comprises a vacuum seal lid, having a flat top portion and a ring portion, wherein the ring portion comprises an O-ring hole along a circumference of the ring portion for accepting an O-ring to create a vacuum seal.

Embodiments in accordance with the present invention provide a method for assembling a cylindrical container. The method comprising: connecting a plurality of side panels with one another to form an insulated cover to be attached around a main body, wherein each of the plurality of side panels comprises a top panel lip and a bottom panel lip; screwing a bottom lid with the main body, wherein the bottom lid comprises a bottom lid thread on an outer surface of an interior wall, which is screwed onto a bottom thread of an extended bottom wall provided at a bottom end of the main body; inserting the bottom panel lip of each of the plurality of connected side panels into a bottom lid pocket of the bottom lid; screwing a standard lid, having an interior lid thread on an outer surface of an interior wall, onto an interior thread of a lip provided at a top end of the main body such that the top panel lip of each of the plurality of connected side panels is fixedly engaged within a top lid pocket of the standard lid; and attaching a vacuum seal lid, by pushing the vacuum seal lid into an opening of the main body such that an O-ring held within an O-ring hole of the vacuum seal lid creates a vacuum seal against the interior wall of the standard lid.

Embodiments in accordance with the present invention may provide a number of advantages depending on its particular configuration. First, embodiments of the present invention provide a cylindrical container having a plurality of side panels used to customize and/or personalize the cylindrical container. Next, embodiments of the present invention provide a cylindrical container having a plurality of side panels used as an insulating cover that protects hands of a user from a hot and/or a cold beverage stored in the cylindrical container and further protects the hot and/or the cold beverage stored in the cylindrical container from elements slowing a cooling and/or a heating rate of the stored beverage. Further, embodiments of the present invention provide a cylindrical container that may be used for advertisement purposes. Also, the embodiments of the present invention provide a cylindrical container that may allow the user to remove the advertisement provided by a seller and replace it with items of their choice in any shape and size.

Next, embodiments of the present invention provide a cylindrical container having an interchangeable top lid, an interchangeable bottom lid, and a plurality of side panels of different colors for changing a color combination of the cylindrical container. Further, each of the top lid, the bottom lid, as well as the side panels are designed of a plurality of different colors for changing a color combination of the cylindrical container. In addition, embodiments of the present invention provide a cylindrical container that may have the ability to get rid of multiple conventional space taking cylindrical containers that fills the cabinets. Next, embodiments of the present invention provide a cylindrical container that may support any type of a lid such as, but not limited to, a standard lid, a coffee style lid, a screw lid, etc. to meet the personal preferences of the user. Therefore, embodiments of the present invention provide a cylindrical container that may solve all the issues comprising, but not limited to, space saving, customization issues, spending concerns, drinking preferences, or ability to keep expressing or displaying items as per the user's choice.

These and other advantages will be apparent from the present application of the embodiments described herein.

The preceding is a simplified summary to provide an understanding of some embodiments of the present invention. This summary is neither an extensive nor exhaustive overview of the present invention and its various embodiments. The summary presents selected concepts of the embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The above and still further features and advantages of embodiments of the present invention will become apparent upon consideration of the following detailed description of embodiments thereof, especially when taken in conjunction with the accompanying drawings, and wherein.

Figure 1A:
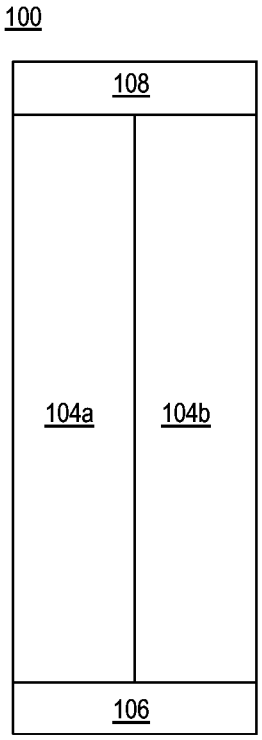
FIG. 1A illustrates a front view of an assembled cylindrical container, according to an embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures. Optional portions of the figures may be illustrated using dashed or dotted lines, unless the context of usage indicates otherwise.

DETAILED DESCRIPTION

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

Figure 2A:
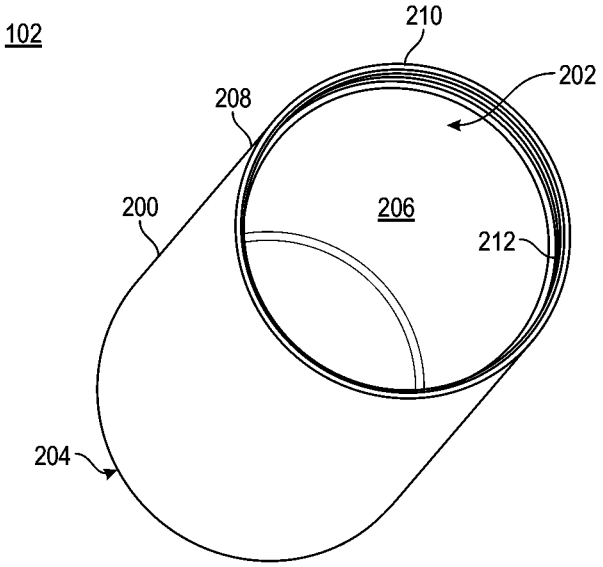
FIG. 2A illustrates a top perspective view of a main body of the cylindrical container, according to an embodiment of the present invention.

FIG. 1A illustrates a front view of an assembled cylindrical container 100, according to an embodiment of the present invention. The cylindrical container 100 may be a cylindrically shaped container designed to hold a beverage, in an embodiment of the present invention. The beverage may be, but not limited to, water, coffee, tea, juice, and so forth. Embodiments of the present invention are intended to include or otherwise cover any type of the beverage, including known, related art, and/or later developed beverages. In another embodiment of the present invention, the cylindrical container 100 may be designed to hold a solid material, such as, but not limited to, a cooking powder, a seasoning, a bead, a craft item, and so forth. Embodiments of the present invention are intended to include or otherwise cover any type of the solid material, including known, related art, and/or later developed solid materials. According to embodiments of the present invention, the cylindrical container 100 comprises a main body 102 (as shown in FIG. 2A), a plurality of side panels 104*a*-104*b* (hereinafter referred to as the side panels 104), a bottom lid 106, and a standard lid 108 that may be used as a top lid for sealing the cylindrical container 100. Further, to assemble the cylindrical container 100, the main body 102, the side panels 104, the bottom lid 106, and the standard lid 108 may be attached to one another, according to an embodiment of the present invention.

Figure 1B:
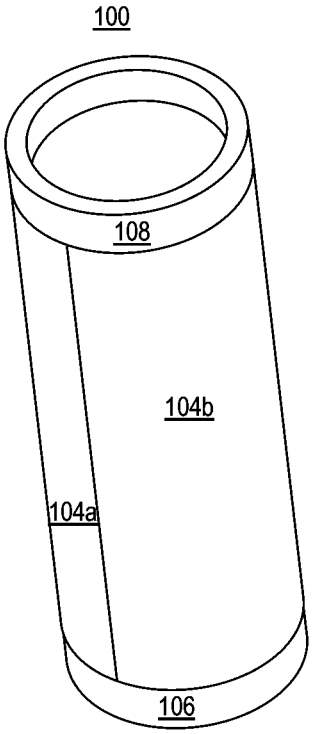
FIG. 1B illustrates a side perspective view of the assembled cylindrical container, according to an embodiment of the present invention.

FIG. 1B illustrates a side perspective view of the assembled cylindrical container 100, according to an embodiment of the present invention. The cylindrical container 100 comprises the main body 102 (as shown in the FIG. 2A), the side panels 104, the bottom lid 106, and the standard lid 108 to be used as the top lid for sealing the cylindrical container 100.

FIG. 2A illustrates a top perspective view of the main body 102 of the cylindrical container 100, according to an embodiment of the present invention. The main body 102 may be a cylindrical shaped enclosed structure designed to hold the beverage and/or the solid material. Further, a size of the main body 102 may be designed such that a beverage holding capacity and/or a solid material holding capacity of the main body 102 may be, but not limited to, 8 ounces, 16 ounces, 64 ounces, and so forth. Embodiments of the present invention are intended to include or otherwise cover any of the size of the main body 102. Further, the main body 102 may be made up of a material such as, but not limited to, a plastic, a metal, wood, and so forth. Embodiments of the present invention are intended to include or otherwise cover any type of the material for the main body 102, including known, related art, and/or later developed technologies.

According to an embodiment of the present invention, the main body 102 may comprise a side wall 200, a top end 202, and a bottom end 204, in an embodiment of the present invention. Further, the top end 202 may have an opening 206 that may allow an access to a hollow chamber formed within the side wall 200, and the bottom end 204. The hollow chamber of the main body 102 may be used for storing the beverage, according to an embodiment of the present invention. Further, the main body 102 may comprise an exterior thread 208 along an outer surface of the side wall 200 near the top end 202. The exterior thread 208 may be designed such that the side panels 104 may rest under the exterior thread 208 while assembling the cylindrical container 100, in an embodiment of the present invention. Furthermore, the main body 102 may comprise a lip 210 at the top end 202 along the side wall 200. The lip 210 may comprise an interior thread 212 along an inner surface that may be provided to accept the standard lid 108 while assembling the cylindrical container 100, in an embodiment of the present invention. In an embodiment of the present invention, a thickness of the lip 210 may be less than a thickness of the side wall 200 such that when the standard lid 108 is screwed with the main body 102, it provides a flush look to an inside of the cylindrical container 100.

Figure 2B:
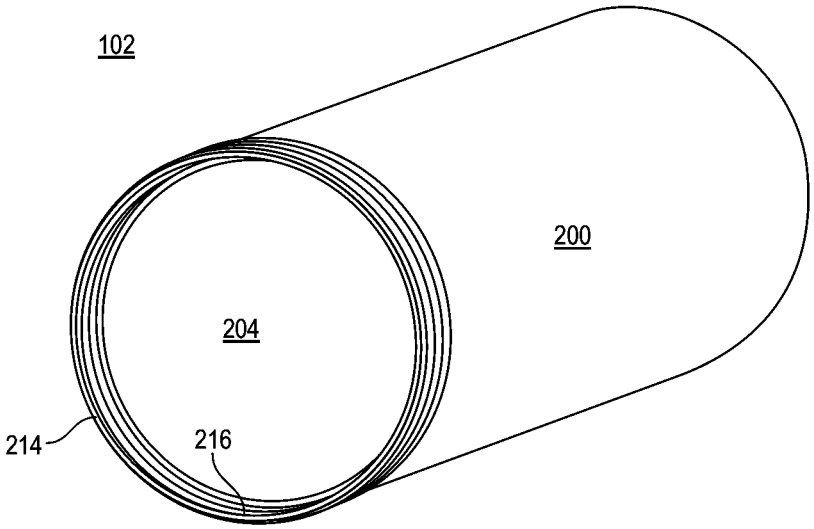
FIG. 2B illustrates a bottom perspective view of the main body of the cylindrical container, according to an embodiment of the present invention.
Figure 4A:
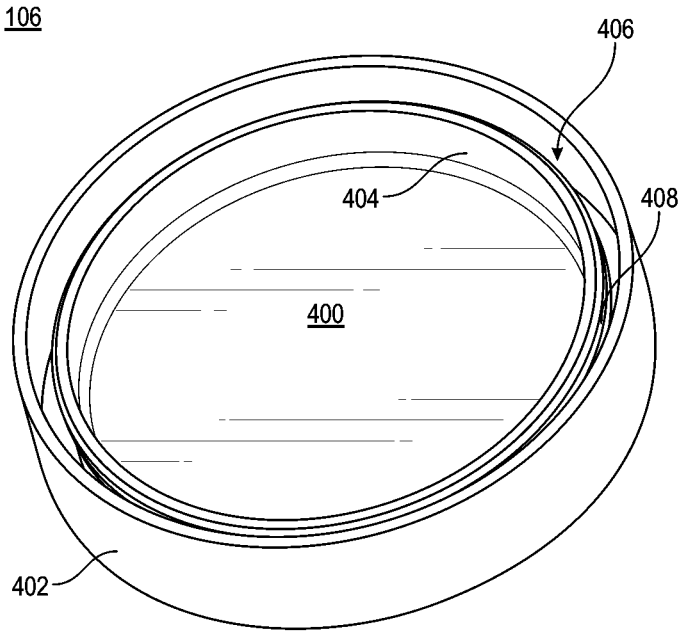
FIG. 4A illustrates a top perspective view of a bottom lid, according to an embodiment of the present invention.

FIG. 2B illustrates a bottom perspective view of the main body 102 of the cylindrical container 100, according to an embodiment of the present invention. The side wall 200 of the main body 102 may comprise an extended bottom wall 214 at the bottom end 204 that may be provided to accept the bottom lid 106 (as shown in FIG. 4A), in an embodiment of the present invention. Further, the extended bottom wall 214 may comprise a bottom thread 216 on an inner surface to accept the bottom lid 106 while assembling the cylindrical container 100, in an embodiment of the present invention. In another embodiment of the present invention, the extended bottom wall 214 may comprise the bottom thread 216 on an outer surface to accept the bottom lid 106 while assembling the cylindrical container 100.

Figure 2C:
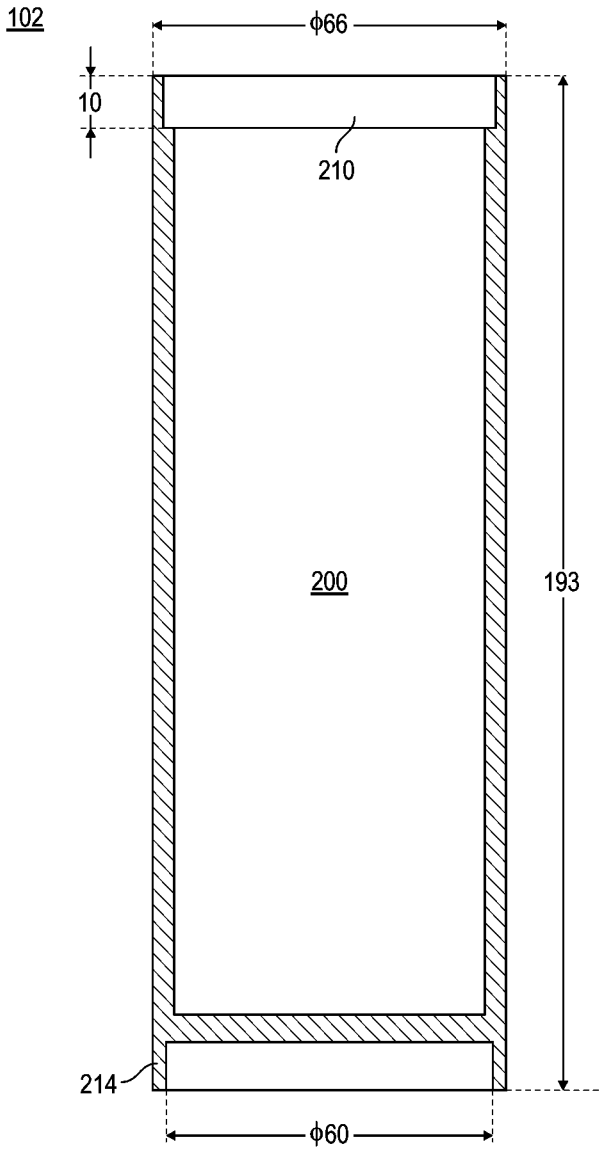
FIG. 2C illustrates a cross sectional view of the main body of the cylindrical container, according to an embodiment of the present invention.

FIG. 2C illustrates a cross sectional view of the main body 102 of the cylindrical container 100, according to an embodiment of the present invention. In an embodiment of the present invention, the main body 102 may have an inner diameter of 60 Millimeters (mm) and an outer diameter of 66 mm. Further, a thickness of the side wall 200 may be 3 mm, according to an embodiment of the present invention. The lip 210 of the main body 102 may have a height of 10 mm and a total height of the main body 102 including the lip 210 and the extended bottom wall 214 may be 193 mm, according to an embodiment of the present invention.

Figure 3A:
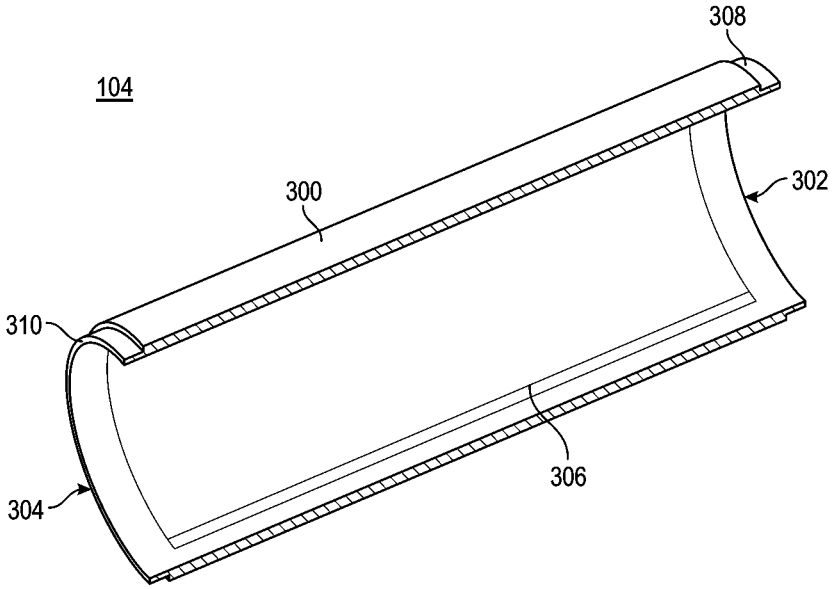
FIG. 3A illustrates a perspective view of a side panel, according to an embodiment of the present invention.

FIG. 3A illustrates a perspective view of the side panel 104, according to an embodiment of the present invention. The side panel 104 may have a semi-cylindrical shape that may be attached to a second side panel 104 forming a cover for the main body 102 for a customization and/or a personalization of the cylindrical container 100, according to an embodiment of the present invention. Further, the side panels 104 may be made up of a transparent material such as, but not limited to, a plastic, a rubber, a Polyvinyl Chloride (PVC), an acrylic, a polycarbonate, and so forth. Embodiments of the present invention are intended to include or otherwise cover any type of the transparent material for making the side panels 104, including known, related art, and/or later developed technologies. The side panels 104 may comprise a body 300, a top edge 302, and a bottom edge 304. Further, the body 300 may comprise a cutout 306 on an inner surface of the side panel 104, which may act like a frame to fixedly hold an item. The item may be for example, but not limited to, a business card, a photograph, a printed design, and so forth, which may be used for advertisement purposes, entertainment purposes, etc. Embodiments of the present invention are intended to include or otherwise cover any of the item to be fixedly held within the cutout 306, including known, related art, and/or later developed technologies. The cutout 306 may be a pocket that may be fixedly attached to the inner surface of the body 300, in an embodiment of the present invention. In another embodiment of the present invention, the cutout 306 may be removably attached to the inner surface of the body 300. Further, the cutout 306 may be made up of a material such as, but not limited to, a plastic, a rubber, a Polyvinyl Chloride (PVC), an acrylic, a polycarbonate, and so forth. Embodiments of the present invention are intended to include or otherwise cover type of the material for making the cutout 306, including known, related art, and/or later developed technologies. According to another embodiment of the present invention, the side panels 104 may be designed in a plurality of colors such as, but not limited to, a red, a blue, a green, a black, a white, and so forth. Embodiments of the present invention are intended to include or otherwise cover any of the color for the side panels 104, including known, related art, and/or later developed technologies.

In an embodiment of the present invention, the side panels 104 may comprise a default pattern printed on an outer surface of the body 300. The default pattern may be, but not limited to, a picture, a design, and so forth. Embodiments of the present invention are intended to include or otherwise cover any of the default pattern printed onto the outer surface of the side panels 104, including known, related art, and/or later developed technologies. According to an embodiment of the present invention, the side panels 104 may be attached to the main body 102 of the cylindrical container 100 to provide an insulation to a user holding the cylindrical container 100 containing a hot beverage and/or a cold beverage. Further, the side panels 104 may provide an insulation to the beverage stored in the main body 102 of the cylindrical container 100 from outside environment that may slow down a heating rate and/or a cooling rate of the beverage inside the cylindrical container 100.

Figure 5A:
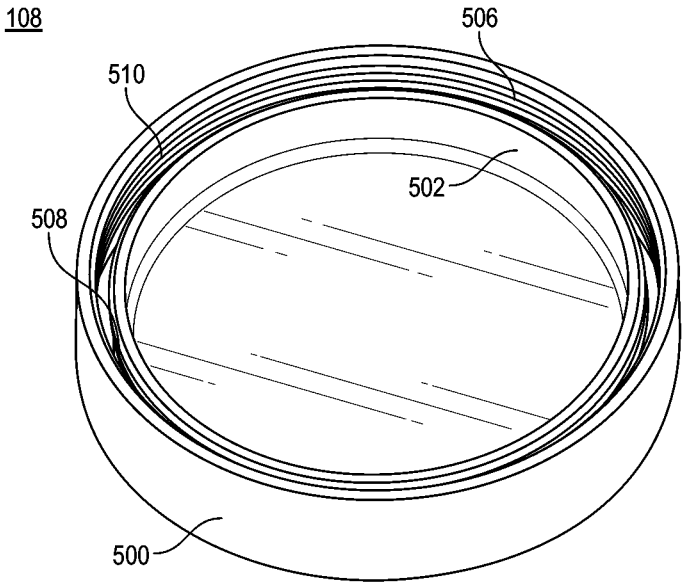
FIG. 5A illustrates a bottom perspective view of a standard lid, according to an embodiment of the present invention.

In an embodiment of the present invention, the side panels 104 may comprise a top panel lip 308 near the top edge 302 along the body 300 and a bottom panel lip 310 near the bottom edge 304 along the body 300. In another embodiment of the present invention, the side panels 104 may comprise only the bottom panel lip 310 near the bottom edge 304 along the body 300. Further, a thickness of the top panel lip 308 and a thickness of the bottom panel lip 310 may be less than a thickness of the body 300 of the side panels 104. Furthermore, the top panel lip 308 and the bottom panel lip 310 may be designed to slide and fit within a top lid pocket 506 of the standard lid 108 (as shown in FIG. 5A) and a bottom lid pocket 406 of the bottom lid 106 (as shown in FIG. 4A), according to an embodiment of the present invention.

Figure 3B:
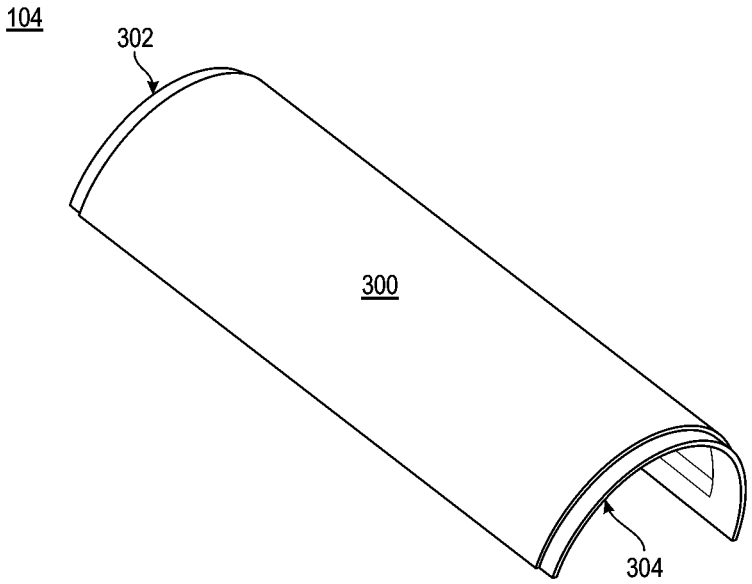
FIG. 3B illustrates another perspective view of the side panel, according to an embodiment of the present invention.

FIG. 3B illustrates another perspective view of the side panel 104, according to an embodiment of the present invention. The side panels 104 may have the semi-cylindrical shape that may be attached to another side panel 104 forming the cover for insulating and/or customizing the main body 102 of the cylindrical container 100, according to an embodiment of the present invention. The side panels 104 may comprise the body 300, the top edge 302, and the bottom edge 304, as discussed above in conjunction with the FIG. 3A.

Figure 3C:
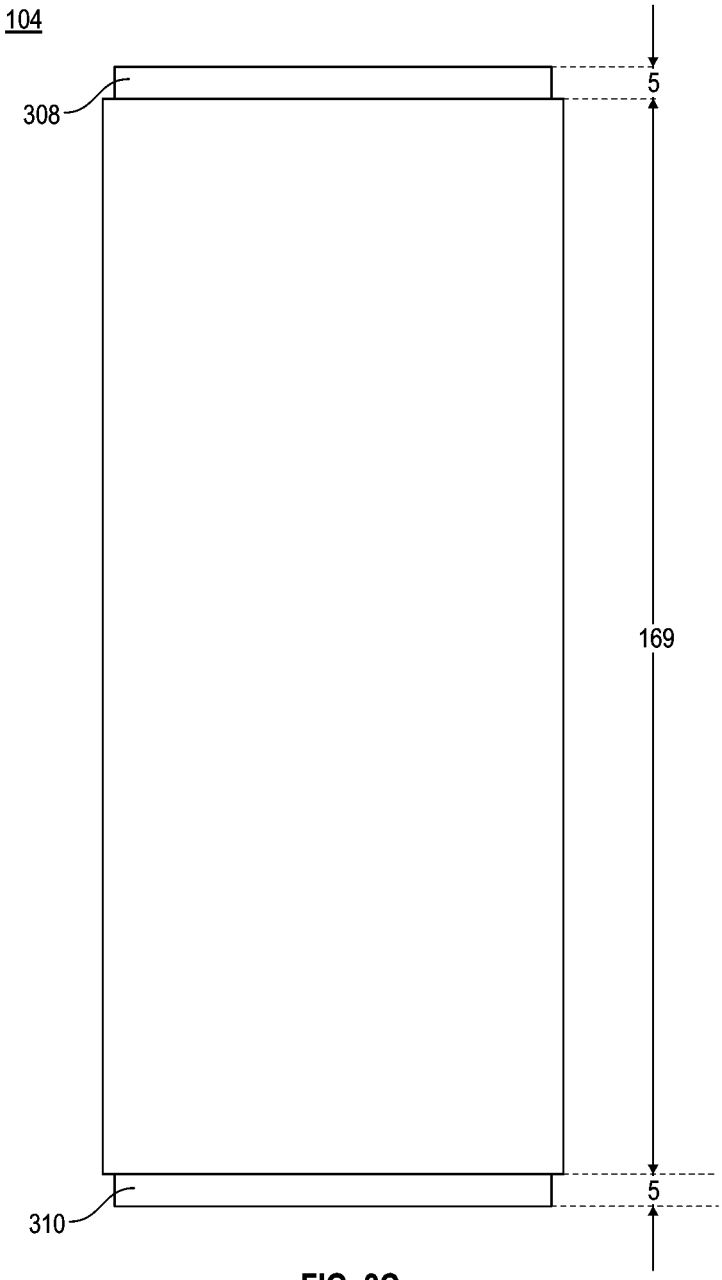
FIG. 3C illustrates a front view of the side panel, according to an embodiment of the present invention.

FIG. 3C illustrates a front view of the side panels 104, according to an embodiment of the present invention. In an embodiment of the present invention, a height of the body 300 of the side panels 104 may be 169 Millimeters (mm). Further, a height of the top panel lip 308 and a height of the bottom panel lip 310 may be 5 mm, according to an embodiment of the present invention. Therefore, a total height of the side panel 104 may be 179 mm.

FIG. 4A illustrates a top perspective view of the bottom lid 106, according to an embodiment of the present invention. The bottom lid 106 may be designed to be screwed onto the bottom thread 216 of the extended bottom wall 214 of the main body 102 for assembling the cylindrical container 100, according to an embodiment of the present invention. The bottom lid 106 may comprise a bottom surface 400, an exterior wall 402, and an interior wall 404, in an embodiment of the present invention. Further, the bottom surface 400, the exterior wall 402, and the interior wall 404 may be made up of a material such as, but not limited to, a plastic, wood, a metal, and so forth. Embodiments of the present invention are intended to include or otherwise cover any type of the material for making the bottom surface 400, the exterior wall 402, and the interior wall 404, including known, related art, and/or later developed technologies. Furthermore, the bottom surface 400, the exterior wall 402, and the interior wall 404 may be designed in a plurality of colors such as, but not limited to, a red, a blue, a green, and so forth. Embodiments of the present invention are intended to include or otherwise cover any color for the bottom surface 400, the exterior wall 402, and the interior wall 404, including known, related art, and/or later developed colors. According to an embodiment of the present invention, the bottom surface 400 may be a flat platform that may act as a rigid support for the exterior wall 402 and the interior wall 404 that may be fixedly attached onto the bottom surface 400 forming a plurality of concentric circles. Further, the exterior wall 402 and the interior wall 404 may extend vertically upwards from the bottom surface 400 to form the bottom lid pocket 406, in an embodiment of the present invention. According to an embodiment of the present invention, the exterior wall 402 may have a height that may be greater than a height of the interior wall 404.

Further, the bottom lid pocket 406 may be provided to accept the bottom panel lip 310 of the side panels 104 (as shown in the FIG. 3A) for assembling the cylindrical container 100, in an embodiment of the present invention. According to an embodiment of the present invention, an outer surface of the interior wall 404 may comprise a bottom lid thread 408 that may be used to screw the bottom lid 106 onto the bottom thread 216 of the extended bottom wall 214 of the main body 102. Further, the bottom lid 106 screwed onto the main body 102 may form a small compartment between the bottom end 204 of the main body 102 and the bottom surface 400 of the bottom lid 106, in an embodiment of the present invention. The small compartment may be provided to securely hold objects such as, but not limited to, money, a ticket, and so forth. Embodiments of the present invention are intended to include or otherwise cover any object to be securely held within the small compartment, including known, related art, and/or later developed technologies.

Figure 4B:
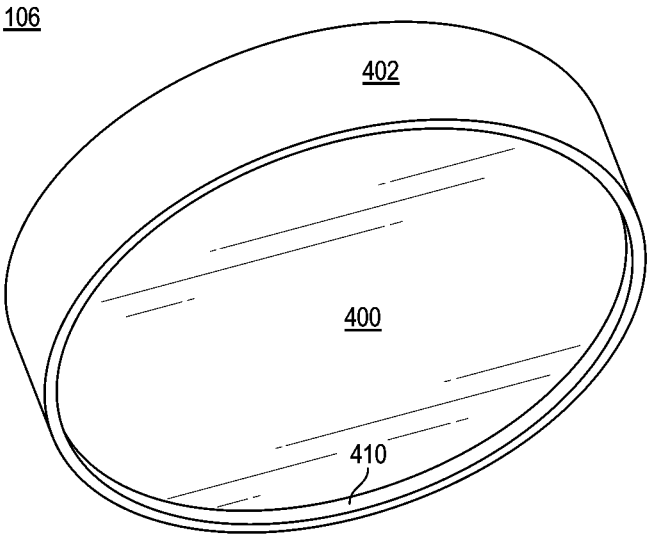
FIG. 4B illustrates a bottom perspective view of the bottom lid, according to an embodiment of the present invention.

FIG. 4B illustrates a bottom perspective view of the bottom lid 106, according to an embodiment of the present invention. The bottom lid 106 may comprise the bottom surface 400 and the exterior wall 402 as discussed above in conjunction with the FIG. 4A. Further, the exterior wall 402 may comprise an extended bottom wall 410 that may extend below the bottom surface 400 to provide a stable base for placing the assembled cylindrical container 100 over a flat surface, according to an embodiment of the present invention.

Figure 4C:
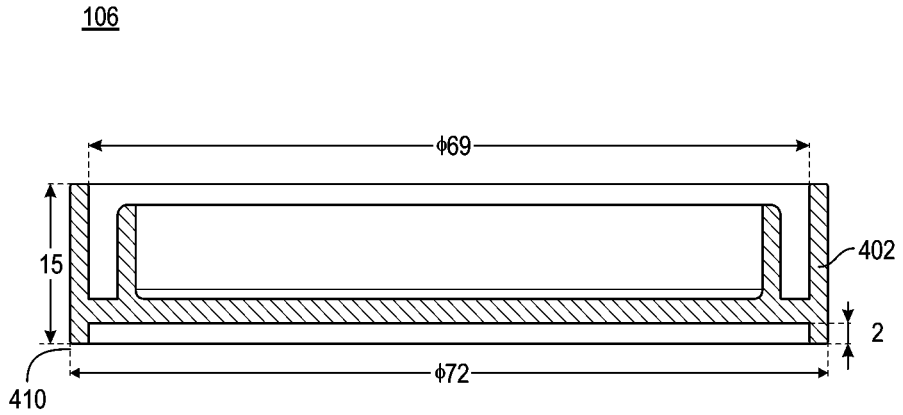
FIG. 4C illustrates a cross sectional view of the bottom lid, according to an embodiment of the present invention.

FIG. 4C illustrates a cross sectional view of the bottom lid 106, according to an embodiment of the present invention. In an embodiment of the present invention, the exterior wall 402 of the bottom lid 106 may have an inner diameter of 69 Millimeters (mm) and an outer diameter of 72 mm. Further, a thickness of the exterior wall 402 may be 1.5 mm, according to an embodiment of the present invention. A height of the bottom lid 106 may be 15 mm and a height of the extended bottom wall 410 may be 2 mm, according to an embodiment of the present invention. Therefore, a total height of the bottom lid 106 may be 17 mm.

Figure 5B:
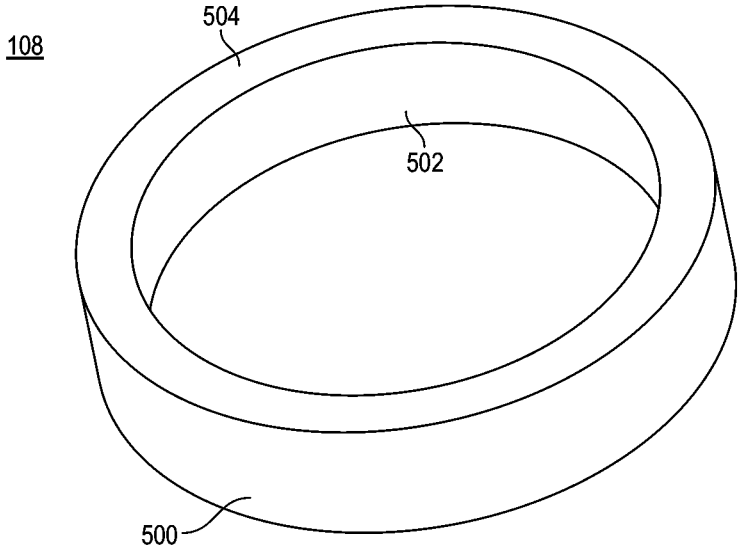
FIG. 5B illustrates a top perspective view of the standard lid, according to an embodiment of the present invention.

FIG. 5A illustrates a bottom perspective view of the standard lid 108, according to an embodiment of the present invention. The standard lid 108 may be designed to be screwed onto the top end 202 of the main body 102 for assembling the cylindrical container 100 that may be open like a regular household drinking cup. In an embodiment of the present invention, the standard lid 108 may be designed to be screwed onto the interior thread 212 of the lip 210 of the main body 102 (as shown in the FIG. 2A) for assembling the cylindrical container 100. In another embodiment of the present invention, the standard lid 108 may be designed to be screwed onto the exterior thread 208 of the main body 102 for assembling the cylindrical container 100. The standard lid 108 may comprise an exterior wall 500, and an interior wall 502. The exterior wall 500 and the interior wall 502 may be made up of a material such as, but not limited to, a plastic, wood, a metal, and so forth. Embodiments of the present invention are intended to include or otherwise cover any type of the material for making the exterior wall 500 and the interior wall 502, including known, related art, and/or later developed technologies. Further, the exterior wall 500 and the interior wall 502 may be designed in a plurality of colors such as, but not limited to, a red, a blue, a green, and so forth. Embodiments of the present invention are intended to include or otherwise cover any color for the exterior wall 500 and the interior wall 502, including known, related art, and/or later developed colors. According to an embodiment of the present invention, the exterior wall 500 and the interior wall 502 may be fixedly attached to one another through a connecting surface 504 (as shown in FIG. 5B) thus forming a plurality of concentric circles. The connecting surface 504 may form a rounded surface between the exterior wall 500 and the interior wall 502, in an embodiment of the present invention. Further, the exterior wall 500 and the interior wall 502 may extend vertically upwards from the connecting surface 504 to form the top lid pocket 506, according to an embodiment of the present invention. In an embodiment of the present invention, the exterior wall 500 may have a height that may be greater than a height of the interior wall 502.

Further, the top lid pocket 506 may be provided to accept the top panel lip 308 of the side panels 104 (as shown in the FIG. 3A) for assembling the cylindrical container 100, in an embodiment of the present invention. Further, an outer surface of the interior wall 502 of the standard lid 108 may comprise an interior lid thread 508 that may be used to screw the standard lid 108 onto the interior thread 212 of the lip 210 of the main body 102 for assembling the cylindrical container 100, in an embodiment of the present invention. According to another embodiment of the present invention, an inner surface of the exterior wall 500 may comprise an exterior lid thread 510 that may be used to screw the standard lid 108 onto the exterior thread 208 of the main body 102 for assembling the cylindrical container 100. According to yet another embodiment of the present invention, the outer surface of the interior wall 502 may comprise the interior lid thread 508 and the inner surface of the exterior wall 500 may comprise the exterior lid thread 510 to screw the standard lid 108 onto the main body 102 of a corresponding size for converting the main body 102 of any size into a vacuum seal lid 600 (as shown in FIG. 6A) compatible with the main body 102.

FIG. 5B illustrates a top perspective view of the standard lid 108, according to an embodiment of the present invention. The standard lid 108 may comprise the exterior wall 500 and the interior wall 502 attached to each other through the connecting surface 504 as discussed in conjunction with the FIG. 5A.

Figure 6A:
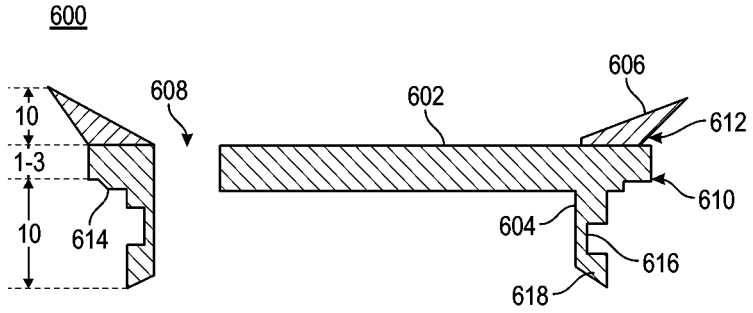
FIG. 6A illustrates a cross sectional view of a vacuum seal lid, according to an embodiment of the present invention.

FIG. 6A illustrates a cross sectional view of the vacuum seal lid 600, according to an embodiment of the present invention. The vacuum seal lid 600 may be used along with the standard lid 108 (as explained in the FIG. 5A and FIG. 5B) to provide a vacuum seal to the cylindrical container 100, according to an embodiment of the present invention. In another embodiment of the present invention, the standard lid 108 may be used internally allowing for the bottom lid 106 to be held through the vacuum seal lid 600. In an embodiment of the present invention, the standard lid 108 may be first screwed onto the interior thread 212 present along the inner surface of the lip 210 of the main body 102 to cover the interior thread 212. Further, the vacuum seal lid 600 may be inserted and pressed into the opening 206 of the main body 102 that may cause the vacuum seal lid 600 to create a vacuum with the interior wall 502 of the standard lid 108 resulting in a vacuum seal for the cylindrical container 100. According to an embodiment of the present invention, the vacuum seal lid 600 comprises a flat top portion 602, a ring portion 604, and a drinking lip 606. Further, the flat top portion 602, the ring portion 604, and the drinking lip 606 may be made up of a material such as, but not limited to, a plastic, a natural rubber, a synthetic rubber, a metal, wood, and so forth. Embodiments of the present invention are intended to include or otherwise cover any type of the material for making the flat top portion 602, the ring portion 604, and the drinking lip 606, including known, related art, and/or later developed technologies. In an embodiment of the present invention, the flat top portion 602, the ring portion 604, and the drinking lip 606 may be fabricated as a single piece. In another embodiment of the present invention, the flat top portion 602, the ring portion 604, and the drinking lip 606 may be fabricated as a plurality of discrete pieces that may be attached together to form the vacuum seal lid 600. Further, the flat top portion 602, the ring portion 604, and the drinking lip 606 may be designed in a plurality of colors such as, but not limited to, a red, a blue, a green, and so forth. Embodiments of the present invention are intended to include or otherwise cover any color for the flat top portion 602, the ring portion 604, and the drinking lip 606, including known, related art, and/or later developed colors.

In an embodiment of the present invention, the flat top portion 602 may further comprise a cavity (not shown) that may form an opening for accepting a slide 620 (as show in FIG. 6B) to seal a drinking hole 608 and the opening when the cylindrical container 100 is not in use. In an embodiment of the present invention, the drinking hole 608 may allow the user of the cylindrical container 100 to easily sip the beverage contained in the cylindrical container 100. According to an embodiment of the present invention, the drinking hole 608 may be a half oval shaped drinking hole that may be capable of holding a straw (not shown). Further, the slide 620 may be capable of closing the drinking hole 608 completely when the user slides the slide 620 above the drinking hole 608 and fits the slide 620 into an indent (not shown) present in the drinking lip 606, thus covering the drinking hole 608 and restricting the flow of the beverage out of the cylindrical container 100, according to an embodiment of the present invention. Furthermore, the flat top portion 602 may comprise a bottom face 610 and a top face 612, according to an embodiment of the present invention. The bottom face 610 may comprise a rounded cut 614 provided along a perimeter of the bottom face 610 that may be designed to fit over the connecting surface 504 of the standard lid 108 when the vacuum seal lid 600 is pressed over the standard lid 108 for attaching the vacuum seal lid 600 to the cylindrical container 100, in an embodiment of the present invention. According to an embodiment of the present invention, a height of the flat top portion 602 may be in a range of 1 Millimeter (mm) to 3 mm.

The ring portion 604 may be designed to fit against the interior wall 502 of the standard lid 108 when the vacuum seal lid 600 is attached onto the standard lid 108, in an embodiment of the present invention. According to an embodiment of the present invention, a diameter of the ring portion 604 may be less than the diameter of the main body 102. Further, the ring portion 604 may comprise an O-ring hole 616 along the circumference of the ring portion 604 that may be provided to accept an O-ring or a ring adapter (not shown) forming a ring gasket that may fill in a gap created by the O-ring hole 616 between the interior wall 502 of the standard lid 108 and the ring portion 604 of the vacuum seal lid 600 causing the vacuum seal, in an embodiment of the present invention. Further, the bottom face 610 of the ring portion 604 may comprise an angled edge 618 that may be provided to assist in the flow of the beverage. The angled edge 618 may have a height in a range of 1 mm to 4 mm, according to embodiments of the present invention. In an embodiment of the present invention, the O-ring hole 616 may have a width of 2 mm and a height of 5 mm. Further, a total height of the ring portion 604 may be 10 mm, in an embodiment of the present invention. In an embodiment of the present invention, the drinking lip 606 may be provided to enable the user of the cylindrical container 100 to easily sip the beverage contained in the cylindrical container 100. The drinking lip 606 may be an angled elevated boundary attached to the top face 612 of the flat top portion 602 that may wrap around the perimeter of the vacuum seal lid 600. According to an embodiment of the present invention, a height of the drinking lip 606 may be 10 mm.

Figure 6B:
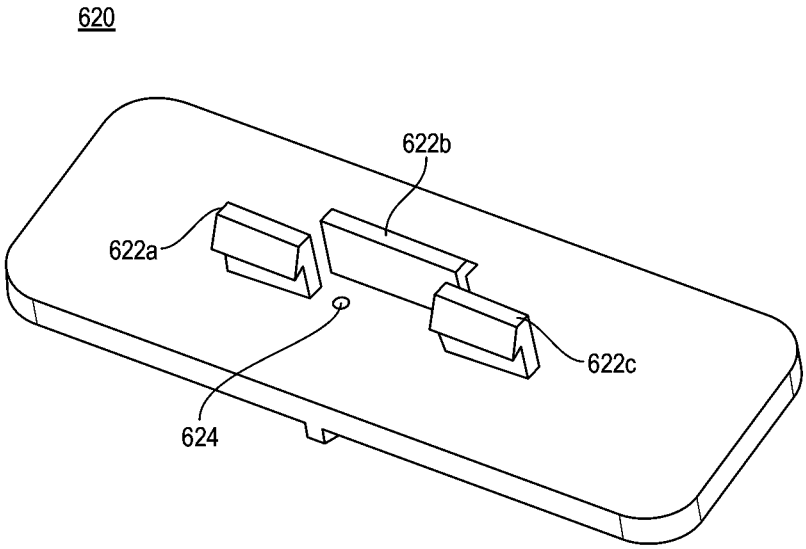
FIG. 6B illustrates a bottom perspective view of a slide, according to an embodiment of the present invention.
Figure 8A:
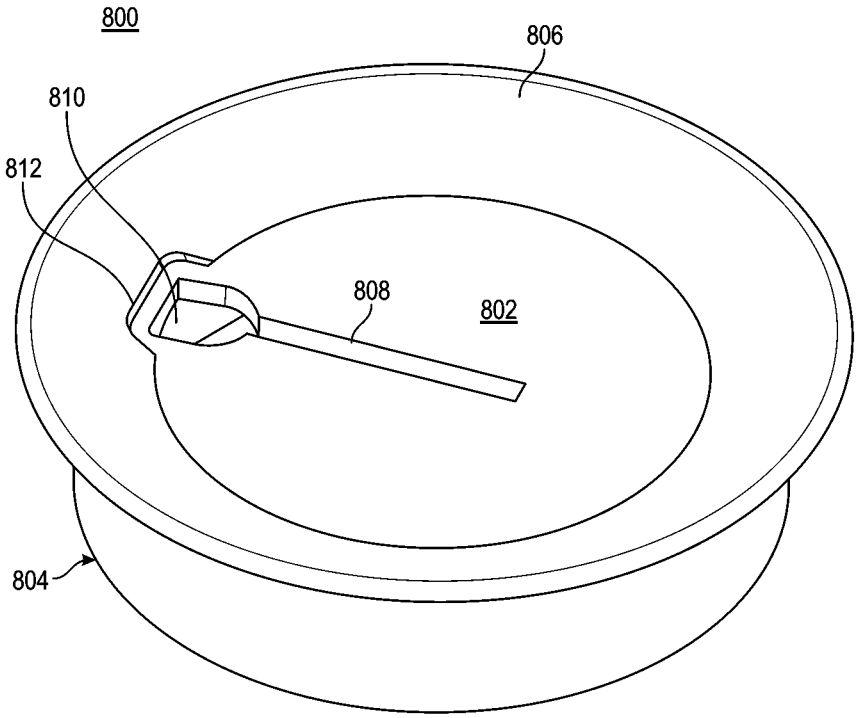
FIG. 8A illustrates a perspective view of a screw lid, according to an embodiment of the present invention.

FIG. 6B illustrates a bottom perspective view of the slide 620, according to an embodiment of the present invention. The slide 620 may be a rigid rectangular piece used to seal the drinking hole 608 and the opening present in the flat top portion 602 of the vacuum seal lid 600, in an embodiment of the present invention. In another embodiment of the present invention, the slide 620 may be used to seal a screw lid 800 (as shown in FIG. 8A). According to embodiments of the present invention, the slide 620 may be made up of a material such as, but not limited to, a plastic, a natural rubber, a synthetic rubber, wood, a metal, and so forth. Embodiments of the present invention are intended to include or otherwise cover any type of the material for making the slide 620, including known, related art, and/or later developed technologies. Further, the slide 620 may be designed in a plurality of colors such as, but not limited to, a red, a blue, a green, and so forth. Embodiments of the present invention are intended to include or otherwise cover any color for the slide 620, including known, related art, and/or later developed colors. In an embodiment of the present invention, the slide 620 may comprise a plurality of clips 622*a*-622*c* (hereinafter referred to as the clips 622) attached to a bottom face of the slide 620, in an embodiment of the present invention. The clips 622 may comprise rounded top portion that may be provided to be engaged within the cavity of the flat top portion 602 of the vacuum seal lid 600 when the slide 620 is snapped into the cavity, according to an embodiment of the present invention. The slide 620 may be capable of sliding within the cavity for opening and/or closing the drinking hole 608 of the vacuum seal lid 600, according to an embodiment of the present invention. Further, the slide 620 may comprise an air hole 624 that may be provided to allow a passage of air into the cylindrical container 100 for a smooth pour of the beverage, according to an embodiment of the present invention.

Figure 6C:
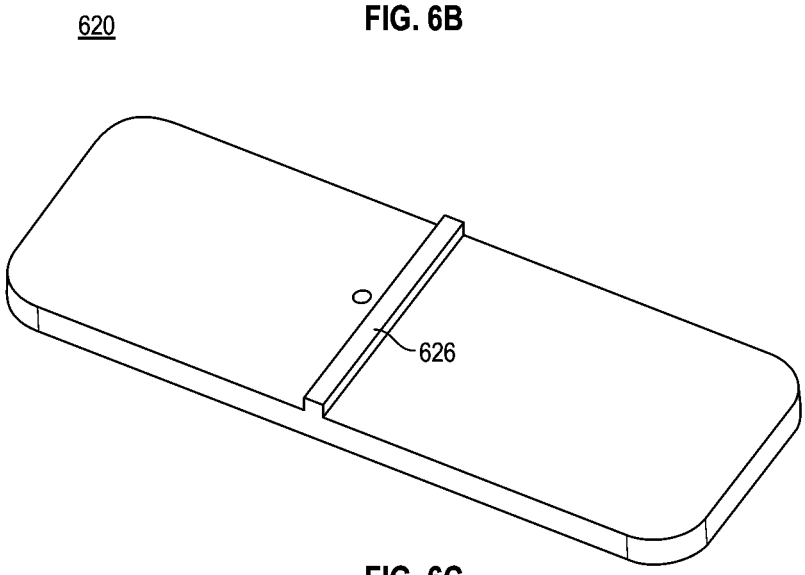
FIG. 6C illustrates a top perspective view of the slide, according to an embodiment of the present invention.

FIG. 6C illustrates a top perspective view of the slide 620 of the vacuum seal lid 600, according to an embodiment of the present invention. A top face of the slide 620 may comprise a barrier 626 that may be provided to enable the user of the cylindrical container 100 to easily slide the slide 620 across the cavity present on the flat top portion 602 of the vacuum seal lid 600, according to an embodiment of the present invention.

Figure 7:
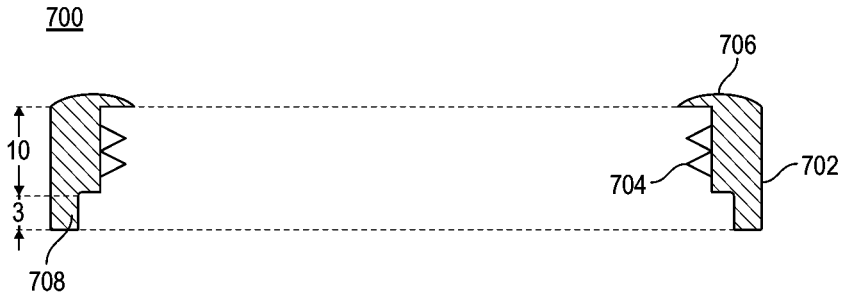
FIG. 7 illustrates a cross sectional view of an open top lid, according to another embodiment of the present invention.

FIG. 7 illustrates a cross sectional view of an open top lid 700 to be used as the top lid of the cylindrical container 100, according to an embodiment of the present invention. The open top lid 700 may comprise a body 702 that may be designed to be screwed onto the exterior thread 208 of the main body 102 for assembling the cylindrical container 100, in an embodiment of the present invention. According to embodiments of the present invention, the body 702 may be made up of a material such as, but not limited to, a plastic, wood, a metal, and so forth. Embodiments of the present invention are intended to include or otherwise cover any type of the material for making the body 702, including known, related art, and/or later developed technologies. Further, the body 702 may be designed in a plurality of colors such as, but not limited to, a red, a blue, a green, and so forth. Embodiments of the present invention are intended to include or otherwise cover any color for the body 702, including known, related art, and/or later developed colors. Furthermore, the body 702 of the open top lid 700 may comprise a thread 704 on an inner surface that may be provided to engage with the exterior thread 208 of the main body 102 when the open top lid 700 is screwed onto the main body 102 for assembling the cylindrical container 100, according to an embodiment of the present invention. In an embodiment of the present invention, the body 702 of the open top lid 700 may comprise a rounded top portion 706 that may be provided to reach over the lip 210 of the main body 102 to provide a flush look to the cylindrical container 100. Further, the body 702 may form a lip 708 at a bottom end of the body 702 that may be provided to accept the top panel lip 308 of the side panels 104 (as shown in the FIG. 3A), according to an embodiment of the present invention. According to an embodiment of the present invention, a total height of the open top lid 700 may be 13 Millimeters (mm). Further, a height of the lip 708 may be 3 mm and a width of the lip 708 may be 1 mm. In an embodiment of the present invention, a total width of the body 702 may be 3 mm and further a width of the thread 704 may be 1 mm.

Figure 9A:
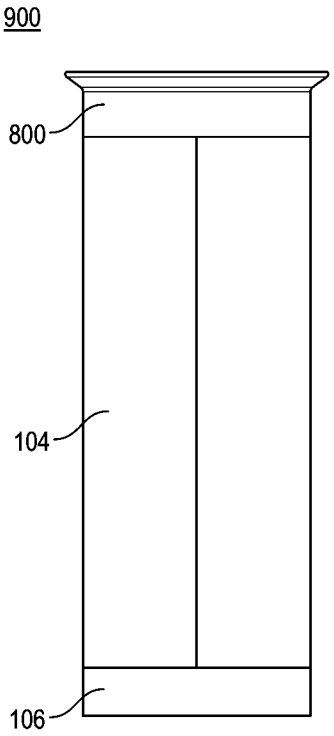
FIGS. 9A-9B illustrate different views of an assembled cylindrical container using the screw lid, according to an embodiment of the present invention.

FIG. 8A illustrates a perspective view of the screw lid 800, according to an embodiment of the present invention. The screw lid 800 may be used as the top lid that may be screwed onto the top end 202 of the main body 102 for assembling a cylindrical container 900 (as shown in FIG. 9A), in an embodiment of the present invention. According to an embodiment of the present invention, the screw lid 800 may comprise a flat top 802, a vertical ring 804, and a drinking lip 806. Further, the flat top 802, the vertical ring 804, and the drinking lip 806 may be made up of a material such as, but not limited to, a plastic, a natural rubber, a synthetic rubber, a metal, wood, and so forth. Embodiments of the present invention are intended to include or otherwise cover any type of the material for making the flat top 802, the vertical ring 804, and the drinking lip 806, including known, related art, and/or later developed technologies. In an embodiment of the present invention, the flat top 802, the vertical ring 804, and the drinking lip 806 may be fabricated as a single piece. In another embodiment of the present invention, the flat top 802, the vertical ring 804, and the drinking lip 806 may be fabricated as a plurality of discrete pieces that may be attached together to form the screw lid 800. Further, the flat top 802, the vertical ring 804, and the drinking lip 806 may be designed in a plurality of colors such as, but not limited to, a red, a blue, a green, and so forth. Embodiments of the present invention are intended to include or otherwise cover any color for the flat top 802, the vertical ring 804, and the drinking lip 806, including known, related art, and/or later developed colors.

According to an embodiment of the present invention, the flat top 802 may further comprise a cavity 808 that may form an opening for accepting the slide 620 (as show in the FIG. 6B) to seal a drinking hole 810 and the opening when the cylindrical container 900 is not in use. In an embodiment of the present invention, the drinking hole 810 may allow the user of the cylindrical container 900 to easily sip the beverage contained in the cylindrical container 900. According to an embodiment of the present invention, the drinking hole 810 may be a semi-oval shaped drinking hole that may be capable of holding a straw (not shown). Further, the slide 620 may be capable of closing the drinking hole 810 completely when the user slides the slide 620 above the drinking hole 810 and fits the slide 620 into an indent 812 present in the drinking lip 806, thus covering the drinking hole 810 and restricting the flow of the beverage out of the cylindrical container 900, according to an embodiment of the present invention.

Figure 8B:
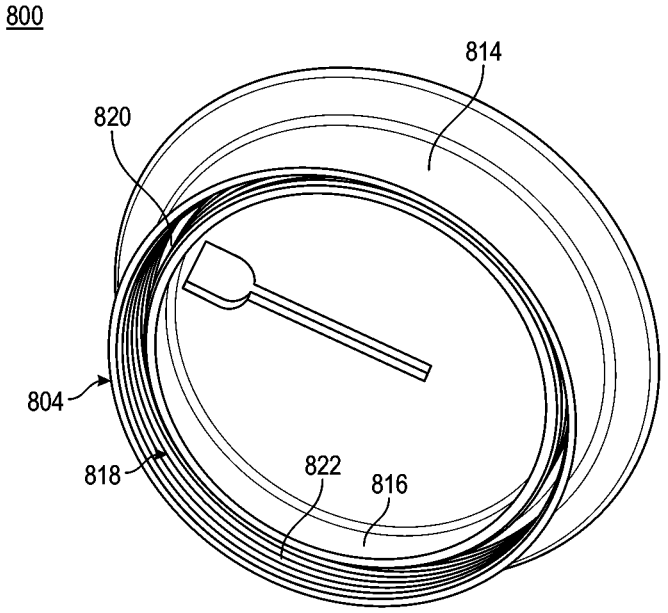
FIG. 8B illustrates a bottom perspective view of the screw lid, according to an embodiment of the present invention.

FIG. 8B illustrates a bottom perspective view of the screw lid 800, according to an embodiment of the present invention. The vertical ring 804 of the screw lid 800 may comprise an exterior wall 814, and an interior wall 816. Further, the exterior wall 814 and the interior wall 816 may extend vertically upwards from the flat top 802 to form a pocket 818, according to an embodiment of the present invention. In an embodiment of the present invention, the exterior wall 814 may have a height that may be greater than a height of the interior wall 816. Further, the pocket 818 may be provided to accept the top panel lip 308 of the side panels 104 (as shown in the FIG. 3A) for assembling the cylindrical container 900, in an embodiment of the present invention. According to an embodiment of the present invention, an outer surface of the interior wall 816 of the screw lid 800 may comprise an interior thread 820 that may be used to screw the screw lid 800 onto the interior thread 212 of the lip 210 of the main body 102 for assembling the cylindrical container 900. According to another embodiment of the present invention, an inner surface of the exterior wall 814 of the screw lid 800 may comprise an exterior thread 822 that may be used to screw the screw lid 800 onto the exterior thread 208 of the main body 102 for assembling the cylindrical container 100.

Figure 8C:
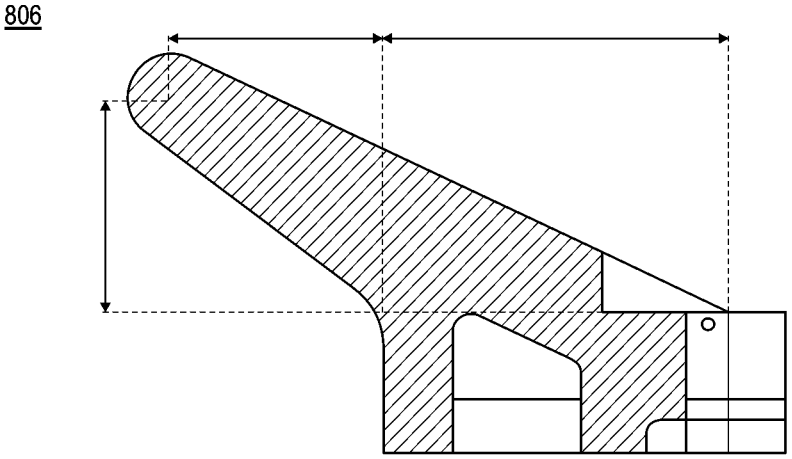
FIG. 8C illustrates a cross sectional view of a drinking lip of the screw lid, according to an embodiment of the present invention.

FIG. 8C illustrates a cross sectional view of the drinking lip 806 of the screw lid 800, according to an embodiment of the present invention. The drinking lip 806 may be provided to enable the user of the cylindrical container 900 to easily sip the beverage contained in the cylindrical container 900, according to an embodiment of the present invention. The drinking lip 806 may be an angled elevated boundary attached to the flat top 802 of the screw lid 800 that may wrap around a perimeter of the screw lid 800 (as shown in the FIG. 8A).

Figure 8D:
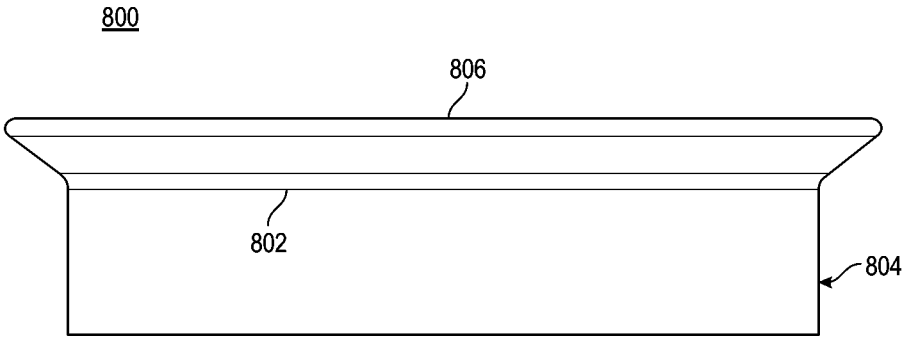
FIG. 8D illustrates a front view of the screw lid, according to an embodiment of the present invention.

FIG. 8D illustrates a front view of the screw lid 800, according to an embodiment of the present invention. The screw lid 800 may be used as the top lid that may be screwed onto the top end 202 of the main body 102 for assembling the cylindrical container 900, in an embodiment of the present invention. According to an embodiment of the present invention, the screw lid 800 comprises the flat top 802, the vertical ring 804, and the drinking lip 806 as discussed in conjunction with the FIG. 8A and the FIG. 8B.

Figure 8E:
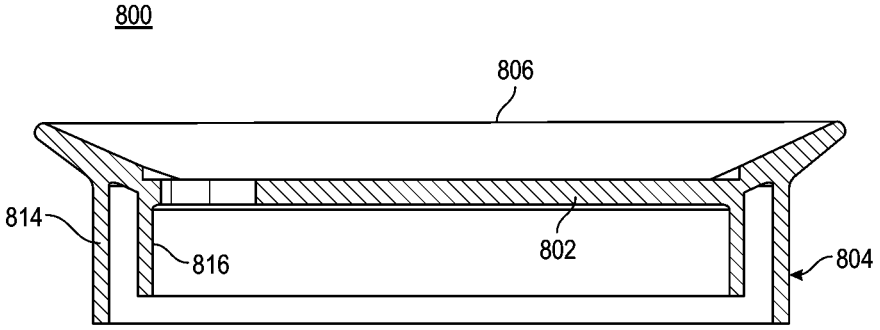
FIG. 8E illustrates a cross sectional view of the screw lid, according to an embodiment of the present invention.

FIG. 8E illustrates a cross sectional view of the screw lid 800, according to an embodiment of the present invention. The screw lid 800 comprises the flat top 802, the vertical ring 804, and the drinking lip 806. The drinking lip 806 may be attached to the flat top 802 that may be provided to enable the user of the cylindrical container 900 to easily sip the beverage contained in the cylindrical container 900, according to an embodiment of the present invention. The vertical ring 804 of the screw lid 800 may comprise the exterior wall 814, and the interior wall 816. In an embodiment of the present invention, the exterior wall 814 may have a height greater than a height of the interior wall 816.

Figure 9B:
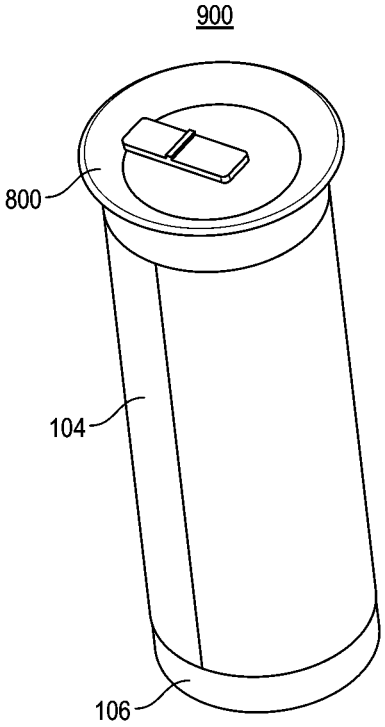

FIGS. 9A-9B illustrate different views of the assembled cylindrical container 900 using the screw lid 800, according to an embodiment of the present invention.

FIG. 9A illustrates a front view of the assembled cylindrical container 900, according to an embodiment of the present invention. The cylindrical container 900 may be a cylindrically shaped container designed to hold the beverage. According to embodiments of the present invention, the cylindrical container 900 comprises the main body 102 (as shown in the FIG. 2A), the side panels 104, the bottom lid 106, and the screw lid 800 to be used as the top lid for sealing the cylindrical container 900. Further, to assemble the cylindrical container 900, the main body 102, the side panels 104, the bottom lid 106 and the screw lid 800 may be attached to one another as discussed above, according to an embodiment of the present invention. In an embodiment of the present invention, the cylindrical container 900 may have an O-ring or a ring adapter (not shown) to hold the side panels 104. The ring adapter may be a simple ring that rests on the side panels 104 when the side panels 104 may be attached to the cylindrical container 900. The ring adapter may have threads on the inside of the ring, in an embodiment of the present invention. The ring having threads on the inside of the ring may be used for a cylindrical container having threads on an outside of the lip. In another embodiment of the present invention, the ring adapter may have threads on the outside of the ring. The ring having threads on the outside of the ring may be used for a cylindrical container having threads on an inside of the lip.

FIG. 9B illustrates a side perspective view of the assembled cylindrical container 900, according to an embodiment of the present invention. The cylindrical container 900 comprises the main body 102, the side panels 104, the bottom lid 106, and the screw lid 800 to be used as the top lid for sealing the cylindrical container 100.

Figure 9C:
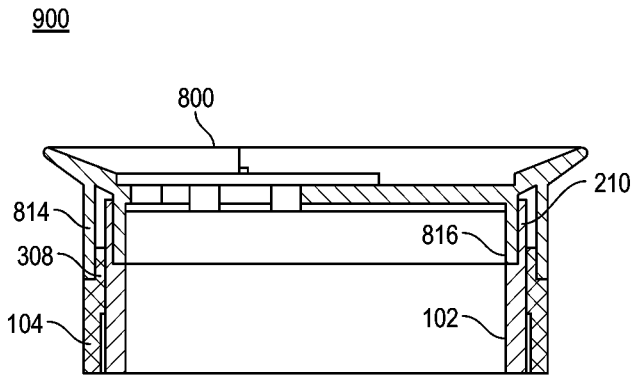
FIG. 9C illustrates a cross sectional view of the assembled cylindrical container using the screw lid, according to an embodiment of the present invention.

FIG. 9C illustrates a cross sectional view of the assembled cylindrical container 900 using the screw lid 800, according to an embodiment of the present invention. The cylindrical container 900 may be assembled by connecting the side panels 104 with each other forming the insulating cover for the main body 102. Further, the bottom lid 106 may be screwed onto the main body 102. Furthermore, the bottom panel lip 310 of the side panels 104 may be inserted into the bottom lid pocket 406 (as shown in the FIG. 9D). Furthermore, the screw lid 800 may be screwed onto the lip 210 of the main body 102 such that the pocket 818 (as shown in the FIG. 8B) formed between the exterior wall 814 and the interior wall 816 of the screw lid 800 accepts the top panel lip 308 of the side panels 104, in an embodiment of the present invention.

Figure 9D:
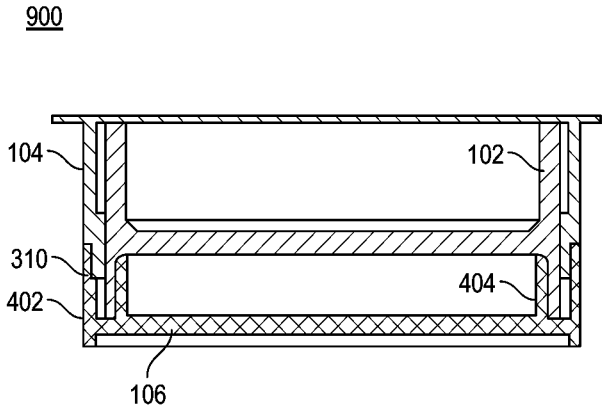
FIG. 9D illustrates another cross sectional view of the assembled cylindrical container using the screw lid, according to an embodiment of the present invention.

FIG. 9D illustrates another cross sectional view of the assembled cylindrical container 900 using the screw lid 800, according to an embodiment of the present invention. The cylindrical container 900 may be assembled by connecting the side panels 104 with each other forming the insulating cover for the main body 102. Further, the bottom lid 106 may be screwed onto the main body 102. Furthermore, the bottom panel lip 310 of the side panels 104 may be inserted into the bottom lid pocket 406 formed between the exterior wall 402 and the interior wall 404 of the bottom lid 106. Furthermore, the screw lid 800 may be screwed onto the main body 102 such that the pocket 818 (as shown in the FIG. 8B) formed between the exterior wall 814 and the interior wall 816 of the screw lid 800 accepts the top panel lip 308 of the side panels 104 (as shown in the FIG. 9C).

Figure 9E:
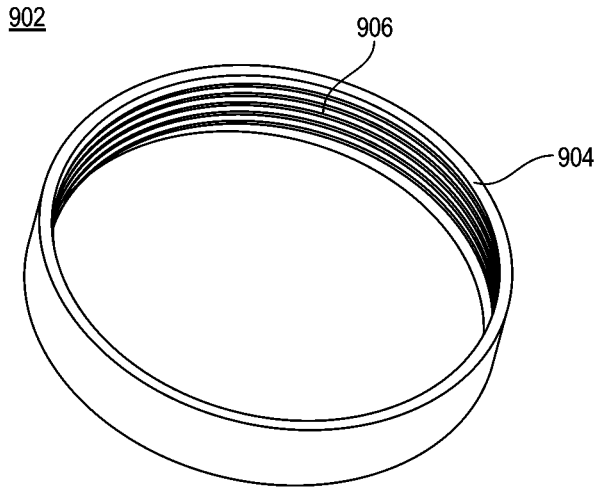
FIG. 9E illustrates a perspective view of a ring adapter, according to an embodiment of the present invention.

FIG. 9E illustrates a perspective view of a ring adapter 902, according to an embodiment of the present invention. The ring adapter 902 may be screwed onto the exterior thread 208 provided along the outer surface of the side wall 200 of the main body 102 (as shown in the FIG. 2A). Further, the ring adapter 902 may rest over the side panels 104 (as shown in the FIG. 3A) when the side panels 104 are installed onto the main body 102 for assembling the cylindrical container 100. According to an embodiment of the present invention, the ring adapter 902 may comprise a wall 904 that may form a circular rigid structure for the ring adapter 902. Further, an upper end and a lower end of the wall 904 may be flat such that the ring adapter 904 wraps around an outer surface of the main body 102. According to an embodiment of the present invention, the wall 904 may be made up of a material such as, but not limited to, a plastic, a metal, wood, and so forth. Embodiments of the present invention are intended to include or otherwise cover any type of the material for the wall 904, including known, related art, and/or later developed technologies. Furthermore, the wall 904 may be designed in different colors such as, but not limited to, a red, a blue, a green, and so forth. Embodiments of the present invention are intended to include or otherwise cover any color for the wall 904, including known, related art, and/or later developed colors. According to an embodiment of the present invention, an inner surface of the wall 904 may comprise a thread 906 that may be capable of engaging with the exterior thread 208 of the main body 102 while screwing the ring adapter 902 onto the main body 102 for assembling the cylindrical container 100.

Figure 9F:
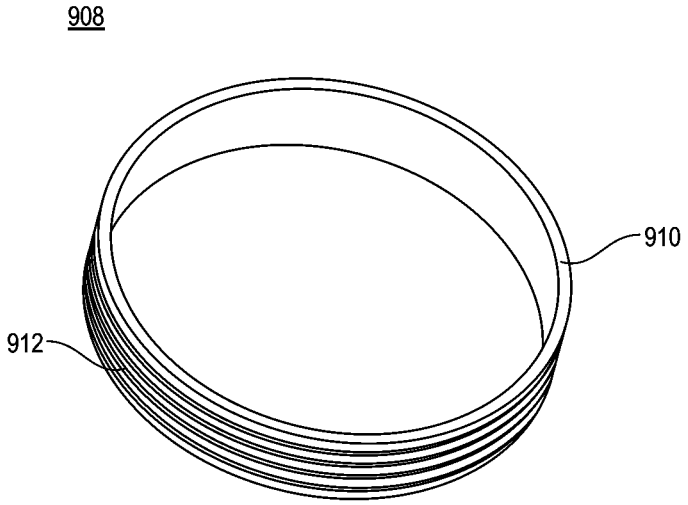
FIG. 9F illustrates a perspective view of the ring adapter, according to another embodiment of the present invention.

FIG. 9F illustrates a perspective view of a ring adapter 908, according to another embodiment of the present invention. The ring adapter 908 may be screwed onto the interior thread 212 provided on the lip 210 of the main body 102 (as shown in the FIG. 2A). Further, the ring adapter 908 may be used to cover the interior thread 212 such that the ring portion 604 of the vacuum seal lid 600 (as shown in the FIG. 6A) may form the vacuum seal with the inner surface of the ring adapter 908 when the vacuum seal lid 600 is pushed into the opening 206 of the main body 102 (as shown in the FIG. 2A). According to an embodiment of the present invention, the ring adapter 908 may comprise a wall 910 that may form a circular rigid structure for the ring adapter 908. Further, an upper end and a lower end of the wall 910 may be flat such that the ring adapter 910 wraps around an inner surface of the lip 210 of the main body 102. According to an embodiment of the present invention, the wall 910 may be made up of a material such as, but not limited to, a plastic, a metal, wood, and so forth. Embodiments of the present invention are intended to include or otherwise cover any type of the material for the wall 910, including known, related art, and/or later developed technologies. Furthermore, the wall 910 may be designed in different colors such as, but not limited to, a red, a blue, a green, and so forth. Embodiments of the present invention are intended to include or otherwise cover any color for the wall 910, including known, related art, and/or later developed colors. According to an embodiment of the present invention, an outer surface of the wall 910 may comprise a thread 912 that may be capable of engaging with the interior thread 212 of the lip 210 of the main body 102 while screwing the ring adapter 908 onto the main body 102 for assembling the cylindrical container 100.

Figure 10A:
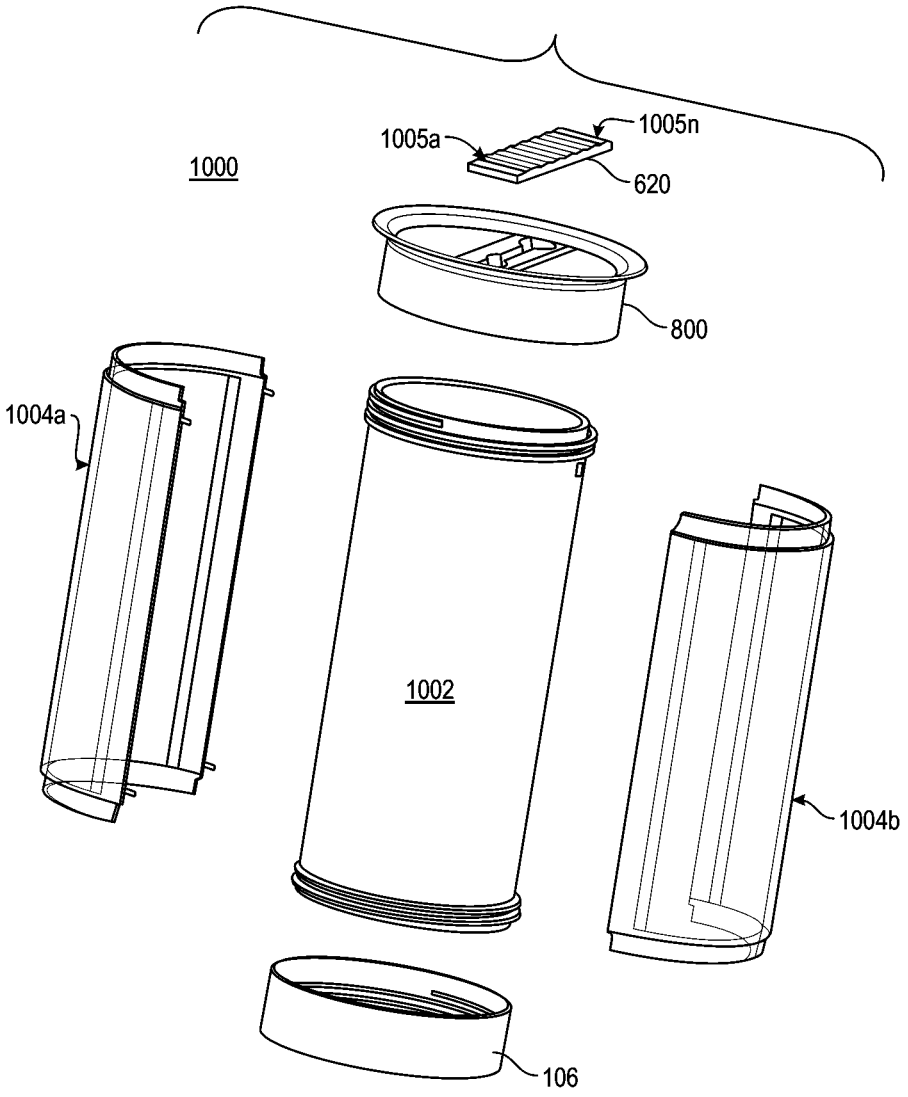
FIG. 10A illustrates an exploded view of a cylindrical container, according to another embodiment of the present invention.

FIG. 10A illustrates an exploded view of a cylindrical container 1000, according to another embodiment of the present invention. The cylindrical container 1000 comprises a main body 1002, a plurality of side panels 1004*a*-1004*b* (hereinafter referred to as the side panels 1004), the bottom lid 106 (as shown in the FIG. 4A), and the screw lid 800 (as shown in the FIG. 8A) that may be used as a top lid for sealing the cylindrical container 1000. Further, to assemble the cylindrical container 1000, the main body 1002, the side panels 1004, the bottom lid 106, and the screw lid 800 may be attached to one another, according to an embodiment of the present invention.

The main body 1002 may be a cylindrical shaped enclosed structure designed to hold a beverage or a solid material. Further, a size of the main body 1002 may be designed such that a beverage holding capacity and/or a solid material holding capacity of the main body 1002 may be, but not limited to, 8 ounces, 16 ounces, 64 ounces, and so forth. Embodiments of the present invention are intended to include or otherwise cover any of the size of the main body 1002. Further, the main body 1002 may be made up of a material such as, but not limited to, a plastic, a metal, wood, and so forth. Embodiments of the present invention are intended to include or otherwise cover any type of the material for the main body 1002, including known, related art, and/or later developed technologies. Further, the main body 1002 will be explained in detail in conjunction with FIG. 10B.

The side panels 1004 may have a semi-cylindrical shape that may be attached to one another forming a cover for the main body 1002 for a customization and/or a personalization of the cylindrical container 1000, according to an embodiment of the present invention. Further, the side panels 1004 may be made up of a transparent material such as, but not limited to, a plastic, a rubber, a Polyvinyl Chloride (PVC), an acrylic, a polycarbonate, and so forth. Embodiments of the present invention are intended to include or otherwise cover any type of the transparent material for making the side panels 1004, including known, related art, and/or later developed technologies. Further, the side panels 1004 will be explained in detail in conjunction with FIG. 10C.

The bottom lid 106 may be designed to be screwed onto the main body 1002 for assembling the cylindrical container 1000, according to an embodiment of the present invention. The bottom lid 106 may comprise the bottom surface 400, the exterior wall 402, and the interior wall 404, as discussed above in conjunction with the FIG. 4A. The screw lid 800 may be used as the top lid that may be screwed onto the main body 1002 for assembling the cylindrical container 1000, in an embodiment of the present invention. According to an embodiment of the present invention, the screw lid 800 may comprise the flat top 802, the vertical ring 804, and the drinking lip 806, as discussed above in conjunction with the FIG. 8A. According to an embodiment of the present invention, the screw lid 800 may comprise the cavity 808 (as shown in the FIG. 8A) that may form an opening for accepting the slide 620 (as show in the FIG. 6B) to seal the drinking hole 810 and the opening when the cylindrical container 1000 is not in use. According to an embodiment of the present invention, the top face of the slide 620 may comprise one or more barriers 1005*a*-1005*n* (hereinafter referred to as the barriers 1005) that may be provided to enable the user of the cylindrical container 1000 to easily slide the slide 620 across the cavity 808 of the screw lid 800, according to an embodiment of the present invention.

Figure 10B:
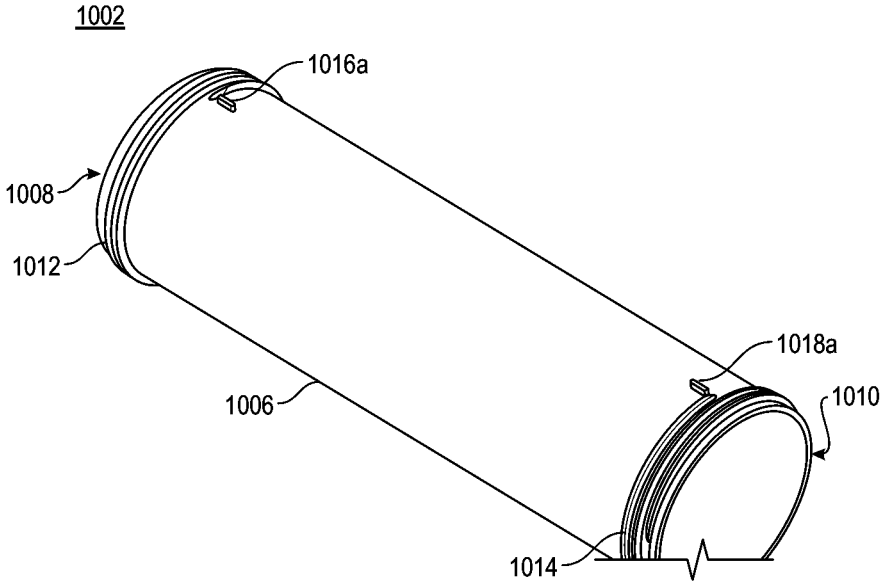
FIG. 10B illustrates a side perspective view of a main body of the cylindrical container, according to an embodiment of the present invention.

FIG. 10B illustrates a side perspective view of the main body 1002 of the cylindrical container 1000, according to an embodiment of the present invention. The main body 1002 may comprise a side wall 1006, a top end 1008, and a bottom end 1010, in an embodiment of the present invention. Further, the main body 1002 may comprise a top thread 1012 along an outer surface of the side wall 1006 near the top end 1008. The top thread 1012 may be designed such that the side panels 1004 may rest under the top thread 1012 while assembling the cylindrical container 1000, in an embodiment of the present invention. Furthermore, the main body 1002 may comprise a bottom thread 1014 along an outer surface of the side wall 1006 near the bottom end 1010. The bottom thread 1014 may be designed such that the side panels 1004 may rest above the bottom thread 1014 while assembling the cylindrical container 1000, in an embodiment of the present invention.

According to an embodiment of the present invention, the main body 1002 may comprise a plurality of top male detents 1016*a*-1016*d* (hereinafter referred to as the top male detents 1016) on the side wall 1006 near the top thread 1012 and a plurality of bottom male detents 1018*a*-1018*d* (hereinafter referred to as the bottom male detents 1018) on the side wall 1006 near the bottom thread 1014. The top male detents 1016 and the bottom male detents 1018 may be provided to engage with the side panels 1004 for fixedly holding the side panels 1004 in place and eliminating a rotation of the side panels 1004 when the screw lid 800 is not attached to the main body 1002. In an embodiment of the present invention, the top male detents 1016 and the bottom male detents 1018 may be a protrusion that may be integrally fabricated within the main body 1002. In another embodiment of the present invention, the top male detents 1016 and the bottom male detents 1018 may be externally attached to the main body 1002.

Figure 10C:
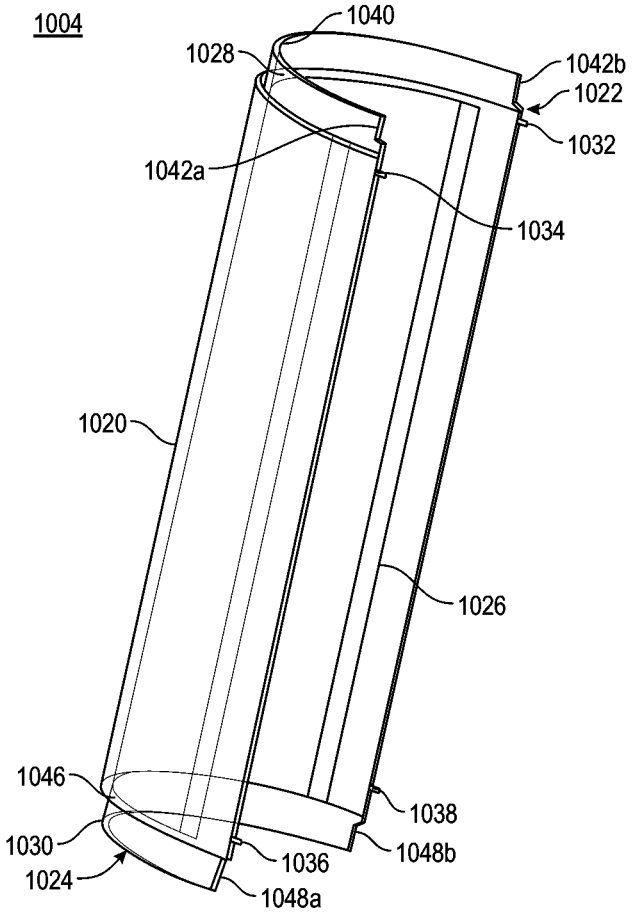
FIG. 10C illustrates one of a plurality of side panels of the cylindrical container, according to an embodiment of the present invention.

FIG. 10C illustrates the side panels 1004 of the cylindrical container 1000, according to an embodiment of the present invention. The side panels 1004 comprises a body 1020, a top edge 1022, and a bottom edge 1024. Further, the body 1020 may comprise a cutout 1026 on an inner surface of the side panels 1004, which may act as a frame to fixedly hold an item. The item may be for example, but not limited to, a business card, a photograph, a printed design, and so forth, which may be used for advertisement purposes, entertainment purposes, etc. Embodiments of the present invention are intended to include or otherwise cover any of the item to be fixedly held within the cutout 1026, including known, related art, and/or later developed technologies. The cutout 1026 may be a pocket that may be fixedly attached to the inner surface of the body 1020, in an embodiment of the present invention. In another embodiment of the present invention, the cutout 1026 may be removably attached to the inner surface of the body 1020. Further, the cutout 1026 may be made up of a material such as, but not limited to, a plastic, a rubber, a Polyvinyl Chloride (PVC), an acrylic, a polycarbonate, and so forth. Embodiments of the present invention are intended to include or otherwise cover type of the material for making the cutout 1026, including known, related art, and/or later developed technologies. According to another embodiment of the present invention, the side panels 1004 may be designed in a plurality of colors such as, but not limited to, a red, a blue, a green, a black, a white, and so forth. Embodiments of the present invention are intended to include or otherwise cover any of the color for the side panels 1004, including known, related art, and/or later developed technologies.

In an embodiment of the present invention, the side panels 1004 may comprise a default pattern printed on an outer surface of the body 1020. The default pattern may be, but not limited to, a picture, a design, and so forth. Embodiments of the present invention are intended to include or otherwise cover any of the default pattern printed onto the outer surface of the side panels 1004, including known, related art, and/or later developed technologies. According to an embodiment of the present invention, the side panels 1004 may be attached to the main body 1002 of the cylindrical container 1000 to provide an insulation to a user holding the cylindrical container 1000 containing a hot beverage and/or a cold beverage. Further, the side panels 1004 may provide an insulation to the beverage stored in the main body 1002 of the cylindrical container 1000 from outside environment that may slow down a heating rate and/or a cooling rate of the beverage inside the cylindrical container 1000.

According to an embodiment of the present invention, the side panels 1004 may comprise a top panel lip 1028 near the top edge 1022 along the body 1020 and a bottom panel lip 1030 near the bottom edge 1024 along the body 1020. Further, a thickness of the top panel lip 1028 and a thickness of the bottom panel lip 1030 may be less than a thickness of the body 1020 of the side panels 1004. According to an embodiment of the present invention, the side panels 1004 may comprise a top male alignment feature 1032, a top female alignment feature 1034, a bottom male alignment feature 1036, a bottom female alignment feature 1038. The top male alignment feature 1032 and the top female alignment feature 1034 may be provided near a bottom end of the top panel lip 1028. Further, the bottom male alignment feature 1036 and the bottom female alignment feature 1038 may be provided near a top end of the bottom panel lip 1030, according to an embodiment of the present invention. Further, the side panels 1004 may comprise a top full ply groove 1040, a plurality of top half ply grooves 1042*a*-1042*b* (hereinafter referred to as the top half ply grooves 1042), a bottom full ply groove 1046, a plurality of bottom half ply grooves 1048*a*-1048*b* (hereinafter referred to as the bottom half ply grooves 1048), in an embodiment of the present invention. The top half ply grooves 1042 may be designed to form a ply groove that may be similar to the top full ply groove 1040 when the side panels 1004 are attached to each another, according to an embodiment of the present invention. Further, the bottom half ply grooves 1048 may be designed to form a ply groove that may be similar to the bottom full ply groove 1046 when the side panels 1004 are attached to each another, according to an embodiment of the present invention. The top full ply groove 1040 and the ply groove formed by the top half ply grooves 1042 may be provided to engage with the top male detents 1016 of the main body 1002. Further, the bottom full ply groove 1046 and the ply groove formed by the bottom half ply grooves 1048 may be provided to engage with the bottom male detents 1018 of the main body 1002, according to an embodiment of the present invention.

Figure 10D:
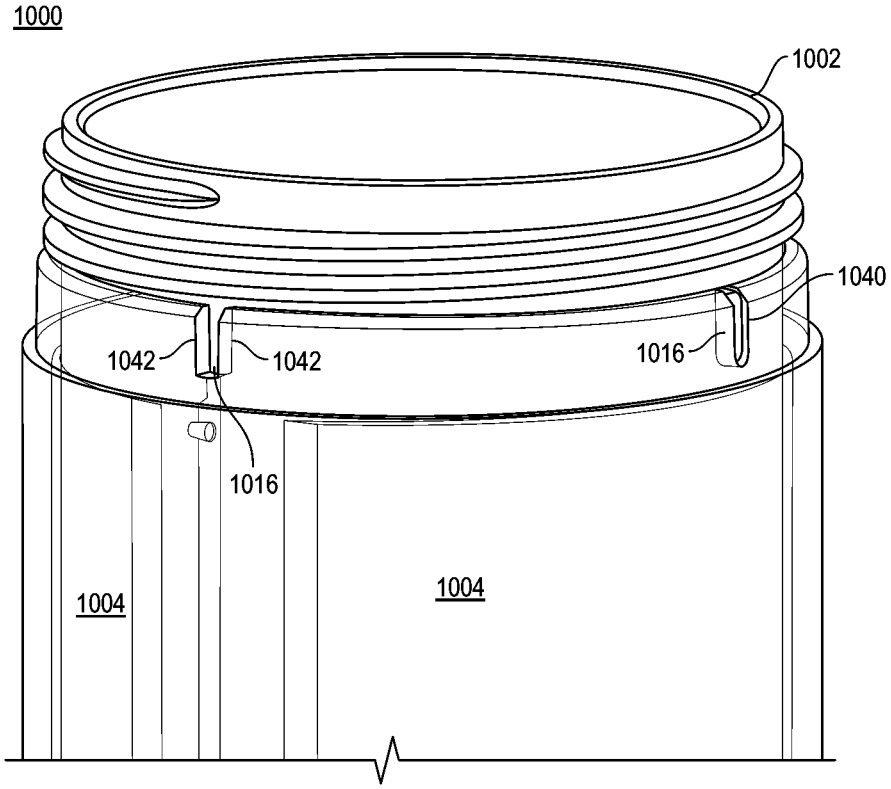
FIG. 10D illustrates a partial assembled view of the main body of the cylindrical container with the side panels, according to an embodiment of the present invention.

FIG. 10D illustrates a partial assembled view of the cylindrical container 1000, according to an embodiment of the present invention. The cylindrical container 1000 may be assembled by attaching the side panels 1004 with each other using the top male alignment feature 1032 of the first side panel 1004 that may be inserted into the top female alignment feature 1034 of the second side panel 1004, in an embodiment of the present invention. Further, the attachment of the side panels 1004 may result in engagement of the top male detents 1016 within the top ply grove 1040 and the ply grove formed by the top half ply groves 1042 of each of the side panels 1004 attached together that may eliminate the rotational movement of the side panels 1004, according to an embodiment of the present invention.

Figure 10E:
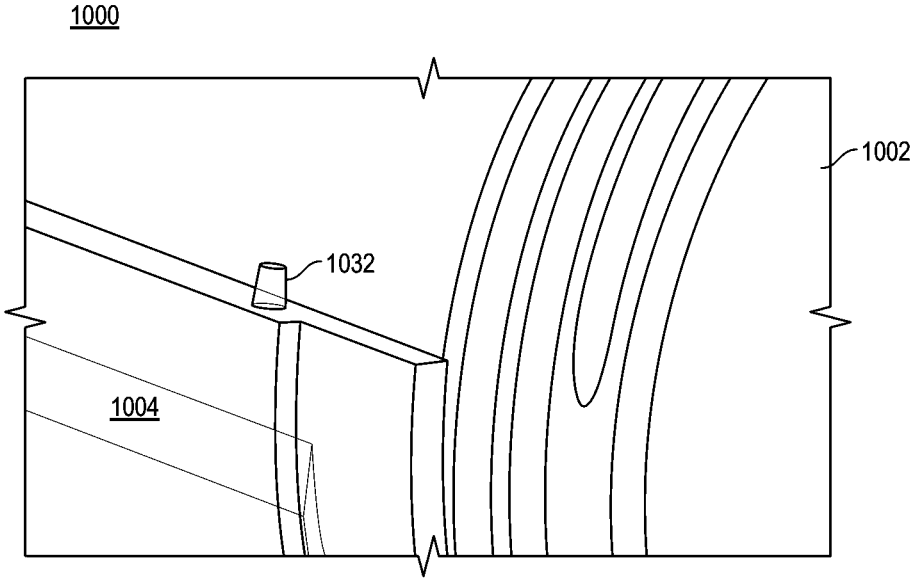
FIG. 10E illustrates a top male alignment feature of the side panels enclosing the main body of the cylindrical container, according to an embodiment of the present invention.

FIG. 10E illustrates the top male alignment feature 1032 of the side panels 1004 enclosing the main body 1002 of the cylindrical container 1000, according to an embodiment of the present invention. The top male alignment feature 1032 may be a tapered cylindrical protrusion extending in an outward direction from a top side of the side panels 1004, according to embodiments of the present invention. In an embodiment of the present invention, the bottom male alignment feature 1036 (as shown in the FIG. 10C) may have a similar structure as the top male alignment feature 1032. According to an embodiment of the present invention, a diameter of the top male alignment feature 1032 and the bottom male alignment feature 1036 may be larger at an end attached to the side panels 1004 than a diameter at an end that may be inserted into the top female alignment feature 1034 and the bottom female alignment feature 1038 (as shown in the FIG. 10C) of the second side panel 1004, respectively. Further, the top male alignment feature 1032 and the bottom male alignment feature 1036 may be integrally fabricated with the side panels 1004, in an embodiment of the present invention. In another embodiment of the present invention, the top male alignment feature 1032 and the bottom male alignment feature 1036 may be externally attached to the side panels 1004.

Figure 10F:
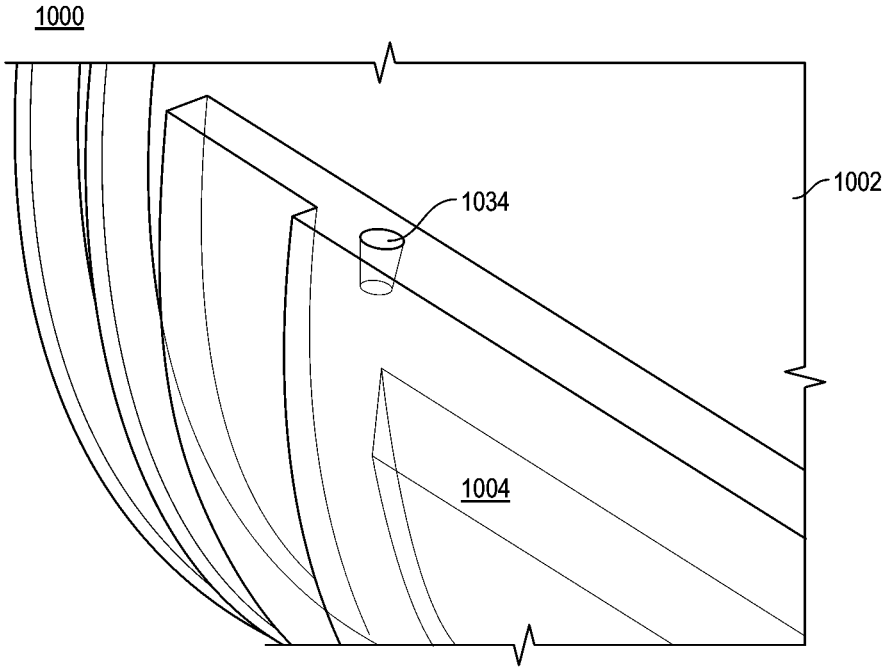
FIG. 10F illustrates a top female alignment feature of the side panels enclosing the main body of the cylindrical container, according to an embodiment of the present invention.

FIG. 10F illustrates the top female alignment feature 1034 of the side panels 1004 enclosing the main body 1002 of the cylindrical container 1000, according to an embodiment of the present invention. The top female alignment feature 1034 may be a tapered hole provided at a top side of the side panels 1004 that may be aligned with the top male alignment feature 1032 of the second side panel 1004, according to embodiments of the present invention. In an embodiment of the present invention, the bottom female alignment feature 1038 (as shown in the FIG. 10C) may have a similar structure as the top female alignment feature 1034. According to an embodiment of the present invention, a diameter of the top female alignment feature 1034 and the bottom female alignment feature 1038 may be larger at a top end than a diameter at a bottom end such that the top female alignment feature 1034 and the bottom female alignment feature 1038 may accept the top male alignment feature 1032 and the bottom male alignment feature 1036 (as shown in the FIG. 10C) of the second side panel 1004 respectively.

Figure 10G:
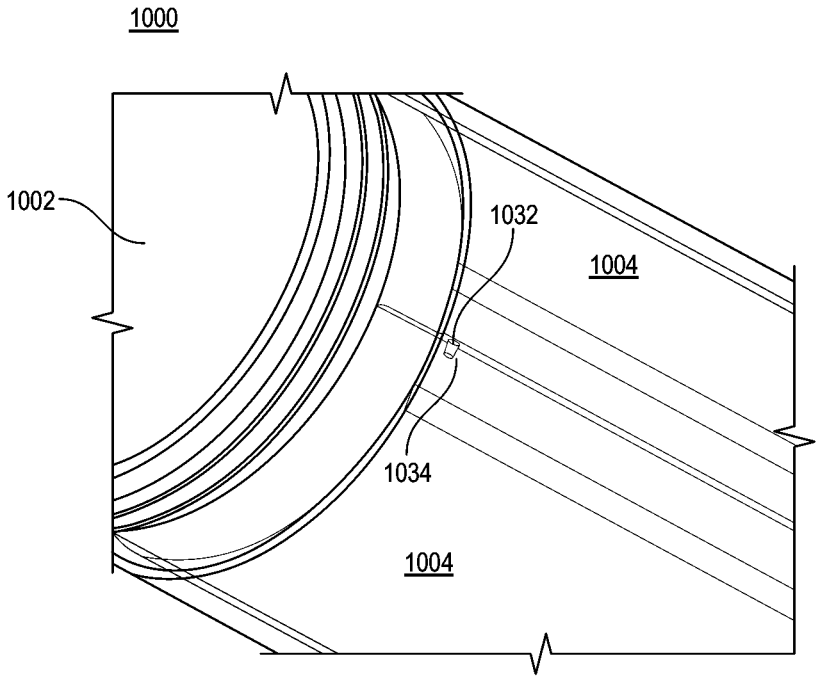
FIG. 10G illustrates another partial view of the cylindrical container with the side panels attached to the main body, according to another embodiment of the present invention.

FIG. 10G illustrates another partial view of the cylindrical container 1000 with the side panels 1004 attached to the main body 1002, according to an embodiment of the present invention. The cylindrical container 1000 may be assembled by attaching the side panels 1004 with each other by using the top male alignment feature 1032 of the first side panel 1004 that may be inserted into the top female alignment feature 1034 of the second side panel 1004 for fixedly attaching the side panels 1004 together onto the main body 1002, in an embodiment of the present invention.

Figure 10H:
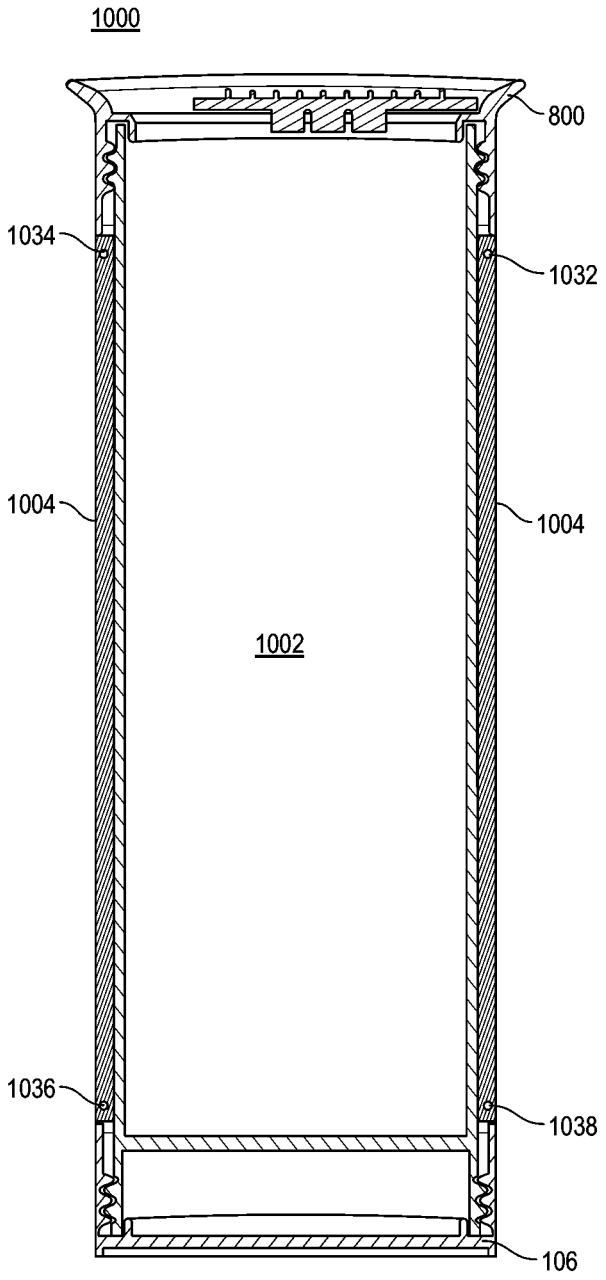
FIG. 10H illustrates a cross sectional view of the assembled cylindrical container, according to an embodiment of the present invention.

FIG. 10H illustrates a cross sectional view of the assembled cylindrical container 1000, according to an embodiment of the present invention. The cylindrical container 1000 may be assembled by attaching the main body 1002, the side panels 1004, the bottom lid 106, and the screw lid 800 to one another, according to an embodiment of the present invention. The bottom lid 106 may be designed to be screwed onto the bottom thread 1014 provided along the outer surface of the side wall 1006 near the bottom end 1010 of the main body 1002 for assembling the cylindrical container 1000, in an embodiment of the present invention. Further, the bottom lid 106 may be screwed onto the top thread 1012 provided along the outer surface of the side wall 1006 near the top end 1008 of the main body 1002 fully enclosing the cylindrical container 1000, according to another embodiment of the present invention. Furthermore, the side panels 1004 may be attached to each other by aligning the top male alignment feature 1032, the top female alignment feature 1034, the bottom male alignment feature 1036 and the bottom female alignment feature 1038 of the first side panel 1004 with the top male alignment feature 1032, the top female alignment feature 1034, the bottom male alignment feature 1036 and the bottom female alignment feature 1038 of the second side panel 1004 and pushing the side panels 1004 against each other for fixedly attaching the side panels 1004 together thus enclosing the main body 1002 of the cylindrical container 1000, according to an embodiment of the present invention.

Figure 11:
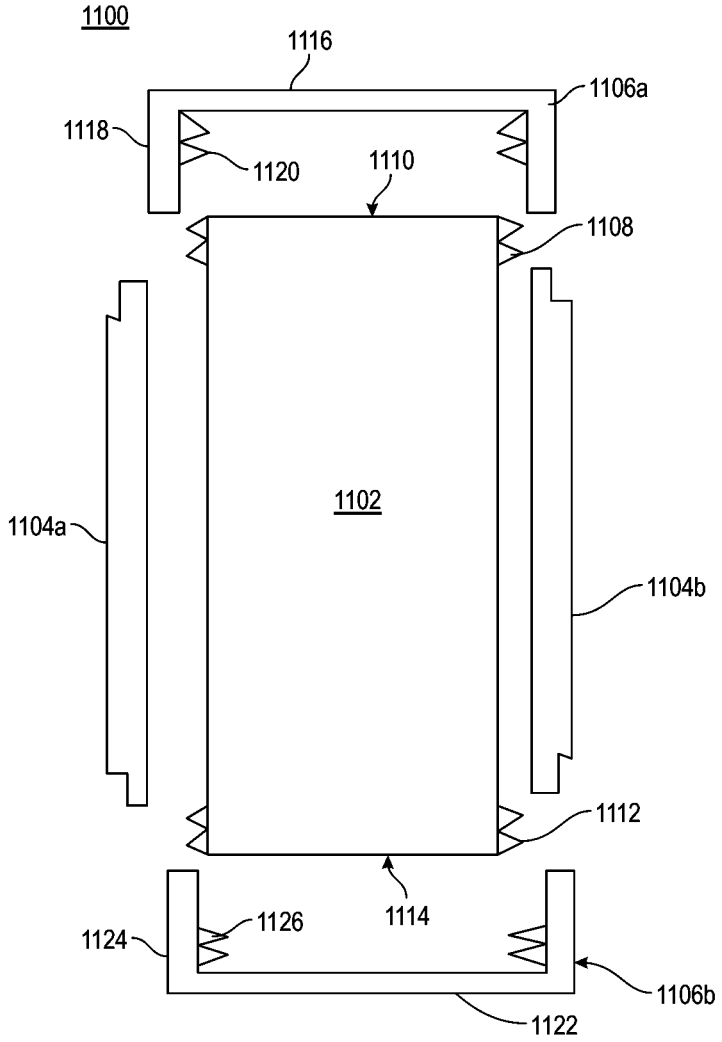
FIG. 11 illustrates a cross sectional view of a cylindrical container to be used as a jar, according to an embodiment of the present invention.

FIG. 11 illustrates a cross sectional view of a cylindrical container 1100 to be used as a jar, according to an embodiment of the present invention. The cylindrical container 1100 may be designed to hold a beverage, in an embodiment of the present invention. The beverage may be, but not limited to, water, coffee, tea, juice, and so forth. Embodiments of the present invention are intended to include or otherwise cover any type of the beverage, including known, related art, and/or later developed beverages. In another embodiment of the present invention, the cylindrical container 1100 may be designed to hold a solid material, such as, but not limited to, a cooking powder, a seasoning, a bead, a craft item, and so forth. Embodiments of the present invention are intended to include or otherwise cover any type of the solid material, including known, related art, and/or later developed solid materials. Further, the cylindrical container 1100 may comprise a main body 1102, a plurality of side panels 1104*a*-1104*b* (hereinafter referred to as the side panels 1104), a top lid 1106*a*, and a bottom lid 1106*b*.

The main body 1102 of the cylindrical container 1100 may be a cylindrical shaped enclosed structure designed to hold the beverage and/or the solid material. Further, a size of the main body 1102 may be designed such that a beverage holding capacity and/or a solid material holding capacity of the main body 1102 may be, but not limited to, 8 ounces, 16 ounces, 64 ounces, and so forth. Embodiments of the present invention are intended to include or otherwise cover any of the size of the main body 1102. Further, the main body 1102 may be made up of a material such as, but not limited to, a plastic, a metal, wood, and so forth. Embodiments of the present invention are intended to include or otherwise cover any type of the material for the main body 1102, including known, related art, and/or later developed technologies. The main body 1102 may comprise a top thread 1108 provided along an outer surface near a top end 1110 of the main body 1102 and a bottom thread 1112 provided along the outer surface near a bottom end 1114 of the main body 1102, according to an embodiment of the present invention. In an embodiment of the present invention, the main body 1102 may be designed similar to a structure of the main body 102 (as shown in the FIG. 2A). In another embodiment of the present invention, the main body 1102 may be designed similar to a structure of the main body 1002 (as shown in the FIG. 10A).

The side panel 1104*a* may have a semi-cylindrical shape that may be attached to a second side panel 1104*b* forming a cover for the main body 1102 for a customization and/or a personalization of the cylindrical container 1100, according to an embodiment of the present invention. Further, the side panels 1104 may be made up of a transparent material such as, but not limited to, a plastic, a rubber, a Polyvinyl Chloride (PVC), an acrylic, a polycarbonate, and so forth. Embodiments of the present invention are intended to include or otherwise cover any type of the transparent material for making the side panels 1104, including known, related art, and/or later developed technologies. In an embodiment of the present invention, the side panel 1104 may be designed similar to a structure of the side panel 104 (as shown in the FIG. 3A). In another embodiment of the present invention, the side panel 1104 may be designed similar to a structure of the side panel 1004 (as shown in the FIG. 10C).

The top lid 1106*a* may be designed to be screwed onto the top thread 1108 provided along the outer surface near the top end 1110 of the main body 1102 for assembling the cylindrical container 1100, in an embodiment of the present invention. Further, the bottom lid 1106*b* may be designed to be screwed onto the bottom thread 1112 provided along the outer surface near the bottom end 1114 of the main body 1102 for fully enclosing the cylindrical container 1100 to be used as the jar for holding the beverage and/or the solid material. According to an embodiment of the present invention, the top lid 1106*a* may comprise a top surface 1116, and an exterior wall 1118. The top surface 1116, and the exterior wall 1118 may be made up of a material such as, but not limited to, a plastic, wood, a metal, and so forth. Embodiments of the present invention are intended to include or otherwise cover any type of the material for making the top surface 1116, and the exterior wall 1118 including known, related art, and/or later developed technologies. Furthermore, the top surface 1116, and the exterior wall 1118 may be designed in a plurality of colors such as, but not limited to, a red, a blue, a green, and so forth. Embodiments of the present invention are intended to include or otherwise cover any color for the top surface 1116, and the exterior wall 1118, including known, related art, and/or later developed colors. According to an embodiment of the present invention, the top surface 1116 may be a flat platform that may act as a rigid support for the exterior wall 1118 that may be fixedly attached onto the top surface 1116. According to an embodiment of the present invention, an inner surface of the exterior wall 1118 may comprise a top lid thread 1120 that may be used to screw the top lid 1106*a* onto the top thread 1108 of the main body 1102.

According to an embodiment of the present invention, the bottom lid 1106*b* may comprise a bottom surface 1122, and an exterior wall 1124. The bottom surface 1122, and the exterior wall 1124 may be made up of a material such as, but not limited to, a plastic, wood, a metal, and so forth. Embodiments of the present invention are intended to include or otherwise cover any type of the material for making the bottom surface 1122, and the exterior wall 1124 including known, related art, and/or later developed technologies. Furthermore, the bottom surface 1122, and the exterior wall 1124 may be designed in a plurality of colors such as, but not limited to, a red, a blue, a green, and so forth. Embodiments of the present invention are intended to include or otherwise cover any color for the bottom surface 1122, and the exterior wall 1124, including known, related art, and/or later developed colors. According to an embodiment of the present invention, the bottom surface 1122 may be a flat platform that may act as a rigid support for the exterior wall 1124 that may be fixedly attached onto the bottom surface 1122. According to an embodiment of the present invention, an inner surface of the exterior wall 1124 may comprise a bottom lid thread 1126 that may be used to screw the bottom lid 1106*b* onto the bottom thread 1112 of the main body 1102.

Figure 12:
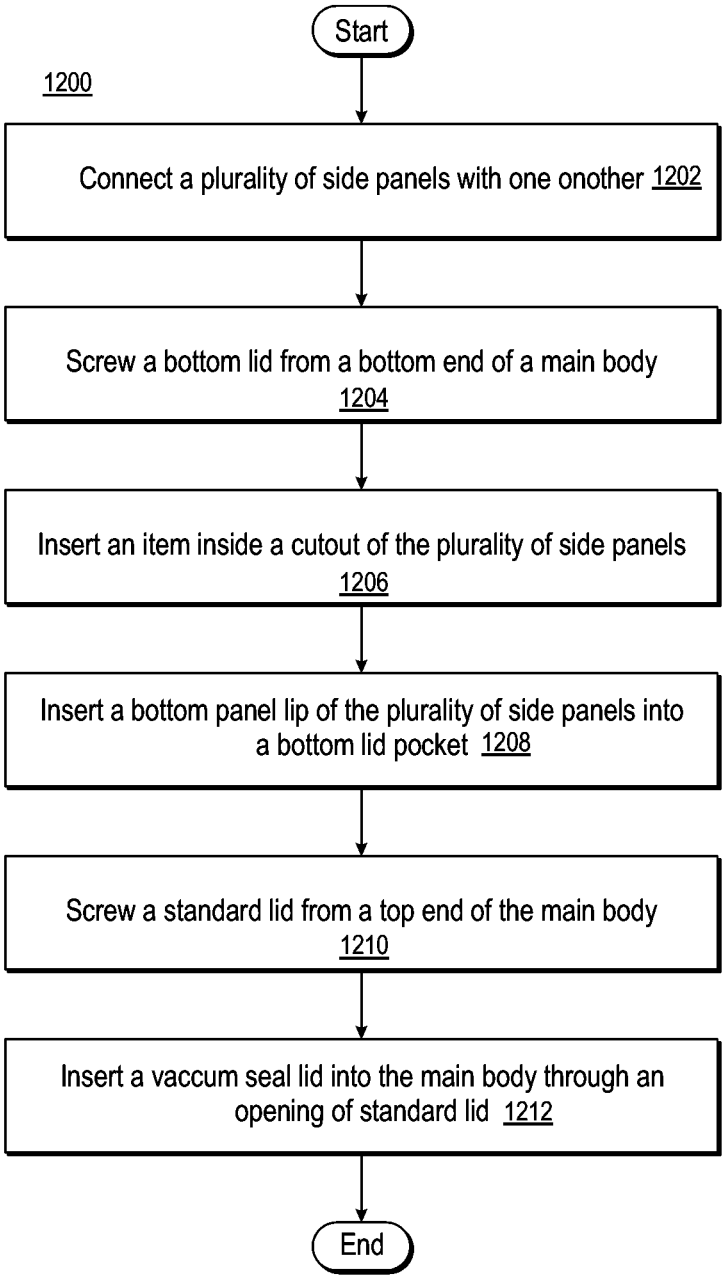
FIG. 12 illustrates a flowchart of a method for assembling the cylindrical container, according to an embodiment of the present invention.

FIG. 12 illustrates a flowchart of a method 1100 for assembling the cylindrical container 100, according to an embodiment of the present invention. At step 1202, the user may connect the side panels 104 with one another forming the insulating cover for the main body 102 of the cylindrical container 100.

At step 1204, the user may screw the bottom lid 106 from the bottom end 204 of the main body 102.

Further, at step 1206, the user may insert the item inside the cutout 306 of the side panels 104. The item may be, but not limited to, a photograph, a business card, a printed design, and so forth.

At step 1208, the user may insert the bottom panel lip 310 of the side panels 104 into the bottom lid pocket 406 formed between the exterior wall 402 and the interior wall 404 of the bottom lid 106.

At step 1210, the user may screw the standard lid 108 onto the top end 202 of the main body 102 such that the top panel lip 308 of the side panels 104 engages within the top lid pocket 506 formed between the exterior wall 500 and the interior wall 502 of the standard lid 108.

At step 1212, the user may insert and push the vacuum seal lid 600 through the opening 206 of the main body 102 such that the O-ring inserted into the O-ring hole 616 presses against the inner surface of the interior wall 502 of the standard lid 108 resulting in the vacuum seal for the cylindrical container 100.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure.

The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

While the foregoing is directed to embodiments of the present disclosure, other and further embodiments of the present disclosure may be devised without departing from the basic scope thereof. It is understood that various embodiments described herein may be utilized in combination with any other embodiment described, without departing from the scope contained herein. Further, the foregoing description is not intended to be exhaustive or to limit the disclosure to the precise form disclosed.

Modifications and variations are possible in light of the above teachings or may be acquired from practice of the disclosure. Certain exemplary embodiments may be identified by use of an open-ended list that includes wording to indicate that the list items are representative of the embodiments and that the list is not intended to represent a closed list exclusive of further embodiments. Such wording may include "e.g.," "etc.," "such as," "for example," "and so forth," "and the like," etc., and other wording as will be apparent from the surrounding context.

What is claimed is:

1. A cylindrical container comprising:

a main body to store a beverage or a solid material, wherein the main body comprising a top end and a bottom end;

a plurality of side panels, attached to one another, to form an insulated cover around the main body, wherein each of the plurality of side panels comprises a top panel lip and a bottom panel lip, and wherein an inner surface of each of the side panels has a cutout in which to hold an item for display through the respective side panel;

a bottom lid, having an exterior wall, an interior wall, and a bottom lid pocket between the exterior wall and the interior wall configured to receive the bottom panel lips of the side panels and an extended bottom wall provided at the bottom end of the main body, wherein a height of the exterior wall is greater than a height of the interior wall, and wherein an outer surface of the interior wall comprises a bottom lid thread to be screwed onto a bottom thread of the extended bottom wall provided at the bottom end of the main body;

a standard lid, having an exterior wall and an interior wall, wherein an outer surface of the interior wall comprises an interior lid thread to be screwed onto an interior thread of a lip provided at the top end of the main body; and a vacuum seal lid, having a flat top portion and a ring portion, wherein the ring portion comprises an O-ring hole along a circumference of the ring portion for accepting an O-ring to create a vacuum seal.

2. The container of claim 1, wherein the top panel lip of each of the plurality of side panels is inserted into a top lid pocket formed between the exterior wall and the interior wall of the standard lid.

3. The container of claim 1, wherein the cutouts are configured to hold an item selected from one of, a business card, a photograph, a printed design, or a combination thereof.

4. The container of claim 1, wherein an inner surface of the exterior wall of the standard lid comprises an exterior lid thread to be screwed onto an exterior thread provided at the top end of the main body.

5. The container of claim 1, wherein the bottom lid forms a small compartment between the bottom end of the main body and a bottom surface of the bottom lid when the bottom lid is screwed onto the main body.

6. The container of claim 1, wherein a height of the exterior wall of the standard lid is greater than a height of the interior wall of the standard lid.

7. The container of claim 1, wherein the flat top portion of the vacuum seal lid comprises a cavity for accepting a slide to close a drinking hole provided on the flat top portion of the vacuum seal lid.

8. The container of claim 7, wherein the slide comprises a plurality of clips to be snapped and engaged into the cavity of the flat top portion.

9. The container of claim 7, wherein the slide comprises an air hole to allow a passage of air into the cylindrical container for a smooth pour of the beverage.

10. The container of claim 7, wherein the slide comprises a barrier for sliding the slide across the cavity for opening and/or closing the drinking hole.

11. A cylindrical container comprising:

a main body, to store a beverage or a solid material, wherein the main body comprising a top end and a bottom end;

a plurality of side panels, attached to one another, to form an insulated cover around the main body, wherein each of the plurality of side panels comprises a top panel lip and a bottom panel lip, and wherein an inner surface of each of the side panels has a cutout in which to hold an item for display through the respective side panel;

a bottom lid, having an exterior wall, an interior wall, and a bottom lid pocket between the exterior wall and the interior wall configured to receive the bottom panel lips of the side panels and an extended bottom wall provided at the bottom end of the main body, wherein a height of the exterior wall is greater than a height of the interior wall, and wherein an outer surface of the interior wall comprises a bottom lid thread to be screwed onto a bottom thread of the extended bottom wall provided at the bottom end of the main body;

a standard lid, having an exterior wall and an interior wall such that a height of the exterior wall is greater than a height of the interior wall, wherein an outer surface of the interior wall comprises an interior lid thread to be screwed onto an interior thread of a lip provided at the top end of the main body, wherein an inner surface of the exterior wall of the standard lid comprises an exterior lid thread to be screwed onto an exterior thread provided at the top end of the main body; and a vacuum seal lid, having a flat top portion and a ring portion, wherein the ring portion comprises an O-ring hole along a circumference of the ring portion for accepting an O-ring to create a vacuum seal.

12. The container of claim 11, wherein the top panel lip of each of the plurality of side panels is inserted into a top lid pocket formed between the exterior wall and the interior wall of the standard lid.

13. The container of claim 11, wherein the cutouts are configured to hold an item selected from one of, a business card, a photograph, a printed design, or a combination thereof.

14. The container of claim 11, wherein the bottom lid forms a small compartment between the bottom end of the main body and a bottom surface of the bottom lid when the bottom lid is screwed onto the main body.

15. The container of claim 11, wherein the flat top portion of the vacuum seal lid comprises a cavity for accepting a slide such that the slide is used to close a drinking hole provided on the flat top portion of the vacuum seal lid.

16. The container of claim 15, wherein the slide comprises a plurality of clips to be snapped and engaged into the cavity of the flat top portion.

17. The container of claim 15, wherein the slide comprises an air hole to allow a passage of air into the cylindrical container for a smooth pour of the beverage.

18. The container of claim 15, wherein the slide comprises a barrier for sliding the slide across the cavity for opening and/or closing the drinking hole.

19. A method for assembling a cylindrical container, the method comprising steps of:

connecting a plurality of side panels with one another to form an insulated cover to be attached around a main body, wherein each of the plurality of side panels comprises a top panel lip and a bottom panel lip, and wherein an inner surface of each of the side panels has a cutout in which to hold an item for display through the respective side panel;

screwing a bottom lid with the main body, wherein the bottom lid comprises an exterior wall, an interior wall, a bottom lid pocket between the exterior wall and the interior wall configured to receive the bottom panel lips of the side panels and an extended bottom wall provided at the bottom end of the main body, and a bottom lid thread on an outer surface of the interior wall, which is screwed onto a bottom thread of the extended bottom wall provided at the bottom end of the main body;

inserting the bottom panel lip of each of the plurality of connected side panels and the extended bottom wall provided at the bottom end of the main body into the bottom lid pocket of the bottom lid;

screwing a standard lid, having an interior lid thread on an outer surface of an interior wall, onto an interior thread of a lip provided at a top end of the main body such that the top panel lip of each of the plurality of connected side panels is fixedly engaged within a top lid pocket of the standard lid; and attaching a vacuum seal lid, by pushing the vacuum seal lid into an opening of the main body such that an O-ring held within an O-ring hole of the vacuum seal lid creates a vacuum seal against the interior wall of the standard lid.

20. The method of claim 19, further comprising inserting an item inside each cutout, wherein the item is selected from one of, a photograph, a business card, a printed design, or a combination thereof.

* * * * *